US011839577B2

(12) United States Patent
Saayman

(10) Patent No.: US 11,839,577 B2
(45) Date of Patent: Dec. 12, 2023

(54) MOBILE LIFTING SYSTEM FOR DISABLED PERSON

(71) Applicant: Pano Solutions Pty. Ltd., Red Hill (AU)

(72) Inventor: Jacobus Hendrik Saayman, Carindale (AU)

(73) Assignee: PANO SOLUTIONS PTY. LTD., Carindale (AU)

( * ) Notice: Subject to any disclaimer, the term of this patent is extended or adjusted under 35 U.S.C. 154(b) by 420 days.

(21) Appl. No.: 17/285,797

(22) PCT Filed: Oct. 16, 2019

(86) PCT No.: PCT/AU2019/051125

§ 371 (c)(1),
(2) Date: Apr. 15, 2021

(87) PCT Pub. No.: WO2020/077404

PCT Pub. Date: Apr. 23, 2020

(65) Prior Publication Data

US 2021/0378898 A1 Dec. 9, 2021

Related U.S. Application Data

(63) Continuation-in-part of application No. 16/161,059, filed on Oct. 16, 2018, now Pat. No. 11,160,708, (Continued)

(30) Foreign Application Priority Data

Dec. 20, 2012 (ZA) ..... 2012/09662

(51) Int. Cl.
*A61G 7/10* (2006.01)

(52) U.S. Cl.
CPC ..... *A61G 7/1019* (2013.01); *A61G 7/1046* (2013.01); *A61G 7/1051* (2013.01); *A61G 7/1067* (2013.01); *A61G 2200/34* (2013.01)

(58) Field of Classification Search
CPC .. A61G 7/1019; A61G 7/1046; A61G 7/1051; A61G 7/1067; A61G 2200/34;
(Continued)

(56) References Cited

U.S. PATENT DOCUMENTS 3,188,657 A * 6/1965 Cotner ..... A61G 7/1076 4/562.1
3,356,184 A 12/1967 Bidgood
(Continued)

FOREIGN PATENT DOCUMENTS

GB 1421368 A 1/1976
JP 6159734 B2 12/1986

*Primary Examiner* — Justin C Mikowski
*Assistant Examiner* — Luke Hall
(74) *Attorney, Agent, or Firm* — David Guerra

(57) ABSTRACT

A mobile lifting system comprising: a base including a plurality of spaced apart legs extending substantially radially relative to a post extending from the base wherein one or more legs of the base are movable between an expanded stabilizing condition and a retracted condition, the post movably supporting a head configured for rotation about the post, the head having a lifting arrangement attached thereto, the lifting arrangement being arranged for effecting upward and downward movement of a body support arrangement to raise and lower a disabled person during use, the body support arrangement being movable between a supporting position and an inoperative position, the body support arrangement being connected to the base through an electro-mechanical linkage combination which moves the base into the stabilizing condition when the body support arrangement is in the supporting position and moves the base into the
(Continued)

retracted condition when the body support arrangement is in the inoperative position; the head being rotatable about the post for rotational movement of the body support arrangement to transfer a person between two seating positions which are angularly displaced and in proximity of the post; wherein end portions of the plurality of legs of the base are arranged substantially equally spaced apart on a diameter about the post when the base is in the stabilizing condition and wherein a first plurality of movable legs are movably attached to a centrally located base housing and a second plurality of fixed legs are fixedly attached to the base housing and wherein each of the movable legs is movable independently with respect to any other of the first plurality of movable legs from a first radial position to a second radial position to bring the base into a partially stabilizing condition; and an actuator configured to be operable by the disabled person to effect movement of the body support arrangement to move the body support arrangement upward and downward on the lifting arrangement and to rotate the head about the post, the post being located substantially at a centre of the base to provide stability as the body support arrangement on the head is rotated about the post While supporting the person and wherein the actuator and the electro-mechanical linkage are operably coupled to move the body support arrangement between a supporting position and an inoperative position.

19 Claims, 18 Drawing Sheets

Related U.S. Application Data which is a continuation of application No. 14/653,920, filed as application No. PCT/IB2013/061195 on Dec. 20, 2013, now Pat. No. 10,117,799.

(58) Field of Classification Search

CPC .. A61G 7/1061; A61G 7/1074; A61G 7/1048; A61G 7/1017; A61G 5/1035; A61G 7/05715; A61G 5/14

USPC ..... 5/87.1

See application file for complete search history.

(56) References Cited

U.S. PATENT DOCUMENTS

| | | | | |
|---|---|---|---|---|
| 3,394,933 | A | 7/1968 | Benoit | |
| 3,815,163 | A * | 6/1974 | Sullivan | A61G 7/1003 4/562.1 |
| 4,206,523 | A | 6/1980 | James | |
| 4,571,758 | A | 2/1986 | Samuelsson | |
| 6,112,346 | A | 9/2000 | Agadzi | |
| 6,119,287 | A * | 9/2000 | Phillips | A61G 7/1046 5/81.1 RP |
| 6,430,761 | B1 * | 8/2002 | Brandorff | A61G 7/053 5/81.1 R |
| 6,665,894 | B2 * | 12/2003 | Moffa | A61G 7/1074 5/424 |
| 7,003,820 | B1 * | 2/2006 | Iura | A61G 7/1092 5/83.1 |
| 8,336,133 | B2 * | 12/2012 | Palay | A61G 7/1017 5/81.1 R |
| 10,117,799 | B2 | 11/2018 | Saayman | |
| 2003/0110561 | A1 | 6/2003 | Porcheron | |
| 2013/0007957 | A1 * | 1/2013 | Chun | A61G 7/1019 5/83.1 |
| 2013/0169017 | A1 * | 7/2013 | Masunaga | A47C 1/03255 297/320 |
| 2015/0313783 | A1 | 11/2015 | Saayman | |

* cited by examiner

MOBILE LIFTING SYSTEM FOR DISABLED PERSON

CROSS-REFERENCE TO RELATED APPLICATIONS

This application is an U.S. national phase application under 35 U.S.C. § 371 based upon co-pending International Application No. PCT/AU2019/051125 filed on Oct. 16, 2019, which claims priority to co-pending U.S. patent application Ser. No. 16/161,059 filed on Oct. 16, 2018. The entire disclosures of the prior applications are incorporated herein by reference. The international application was published on Apr. 23, 2020 under Publication No. WO 2020/077404 A1.

This application is a continuation-in-part under 35 U.S.C. § 120 based upon co-pending U.S. patent application Ser. No. 16/161,059 filed on Oct. 16, 2018, which is incorporated herein by reference in its entirety.

TECHNICAL FIELD

The present invention relates to a lifting device for a disabled person and more specifically but not exclusively for a paraplegic person to facilitate transfer from one seated position to another position.

BACKGROUND

Any references to methods, apparatus or documents of the prior art are not to be taken as constituting any evidence or admission that they formed, or form part of the common general knowledge.

Mobility and accessibility devices, such as wheelchairs, can provide limited mobility and flexibility for users. For example, some conventional wheelchairs, manual or motorized, have a large footprint with generally four wheels. This can make some conventional wheelchairs substantially inherently wide and bulky with a relatively large turning radius. This can restrict some users from accessing smaller common areas not generally designed to accommodate portions of some wheelchairs, such as an office area or desk.

Mobile lifting devices for transferring paraplegic patients from a bed to a wheelchair and vice versa are known. One such device is described in International patent application PCT/IB2013/061195 (incorporated herein by reference and shown in FIG. 1A) is an earlier patent application assigned to the applicant of the present invention. The applicant has found that one of the problems associated with such prior art devices is that the user of the prior art device requires considerable physical strength to pivot the lifting arm arrangement in order to expand the feet members F of the base B through a mechanical linkage into the operative position shown in FIG. 1A. A typical example of how a transfer can be carried out using the prior art device is a scenario where a disabled person needs to be moved from his bed to a lavatory. To do so, the person will manually pivot the lifting arm arrangement A to the lateral, supporting position, consequently moving the legs F into the extended position, an action which requires significant upper body extension and force. These two positions correspond to a stabilizing condition of the base B. Thereafter, rotating the lever L in one direction (which requires significant levels of force), the person will lower the head H with lifting arm arrangement A to a level where he then positions himself in the sling S, then rotates the lever L in the opposite direction to raise himself from the bed. Once the person is raised clear of the bed, he can move the lever L to another protrusion (not shown), turn the lever L to rotate himself about the post P until he is positioned above his wheelchair (not shown). He can then move the lever L back to the original protrusion and rotate the lever in the opposite direction to be lowered onto the wheelchair.

As described above, the lowering of the lifting arm arrangement and turning of the lever L for rotating and lifting the user about the post requires significant manual force and effort by the disabled person. In summary, the prior art devices provide limited options (range of motion) for both rotational and vertical movement about the post P and is particularly difficult to use for overweight or obese users.

Another issue with such prior art devices is that the footprint of the prior art devices in the operative position (with legs F extending outwardly) is too big and not adjustable especially for use in confined spaces.

Therefore, it is desirable to provide an improved mobile lifting system that addresses at least some of the problems of the prior art.

SUMMARY OF INVENTION

In an aspect, the invention provides a mobile lifting system comprising:

a base including a plurality of spaced apart legs extending substantially radially relative to a post extending from the base wherein one or more legs of the base are movable between an expanded stabilizing condition and a retracted condition, the post movably supporting a head configured for rotation about the post, the head having a lifting arrangement attached thereto, the lifting arrangement being arranged for effecting upward and downward movement of a body support arrangement to raise and lower a disabled person during use, the body support arrangement being movable between a supporting position and an inoperative position, the body support arrangement being connected to the base through an electro-mechanical linkage combination which moves the base into the stabilizing condition when the body support arrangement is in the supporting position and moves the base into the retracted condition when the body support arrangement is in the inoperative position;

the head being rotatable about the post for rotational movement of the body support arrangement to transfer a person between two seating positions which are angularly displaced and in proximity of the post;

wherein end portions of the plurality of legs of the base are arranged substantially equally spaced apart on a diameter about the post when the base is in the stabilizing condition and wherein a first plurality of movable legs are movably attached to a centrally located base housing and a second plurality of fixed legs are fixedly attached to the base housing and wherein each of the movable legs is movable independently with respect to any other of the first plurality of movable legs from a first radial position to a second radial position to bring the base into a partially stabilizing condition; and an actuator configured to be operable by the disabled person to effect movement of the body support arrangement to move the body support arrangement upward and downward on the lifting arrangement and to rotate the head about the post, the post being located substantially at a centre of the base to provide stability as the body support arrangement on the head is rotated about the post while supporting the person and wherein the actuator and the electro-mechanical linkage are operably coupled to move the body support arrangement between a supporting position and an inoperative position.

In an embodiment, the electro-mechanical linkage secures the base in the stabilizing condition while the arm arrangement remains in the supporting position.

In an embodiment, the electro mechanical linkage comprises a sensing arrangement to sense physical movement of the lifting arm arrangement and a processing unit in communication with the sensing arrangement to, in response to sensing physical movement of the lifting arm arrangement, transmit an electronic signal for operation of a motor to effect a movement of the legs in the base.

In an embodiment, the electro mechanical linkage comprises an electronic controller for allowing the disabled person to control and effect movement of the lifting arm arrangement and legs.

In an embodiment, the partially stabilizing condition which corresponds to a partial rotation of the head about the post through an angle of less than 180 degrees and more preferably through an angle of more than 90 degrees.

In an embodiment, each of the movable legs is movable independently with respect to any other of the first plurality of movable legs from the first radial position towards one of the plurality of fixed legs located adjacent said movable leg to bring the base into the partially stabilizing condition which corresponds to the partial rotational of the head about the post.

In an embodiment, the actuator is selected from the group consisting of a control panel provided on the head, a wired remote control provided on the head; and a control panel provided on the head associated with wireless remote controlling means.

In an embodiment, the actuator is accessible to the person supported by the lifting arm arrangement for effecting control of the functions of the lifting device.

In an embodiment, the actuator is accessible to the person while not supported by the lifting arm arrangement for effecting control of the functions of the lifting device.

In an embodiment, the actuator turns an outer rotary gear, rotatably supported in relation to the head that runs on track provided by an inner annular gear, which is coaxial and fixed relative to the post.

In an embodiment, the outer rotary gear is turned by one or motors to effect driven rotation of the head about the post.

In an embodiment, the outer rotary gear is configured to be disengaged from the inner annular gear allowing free rotation of the head about the post.

In an embodiment, the mobile lifting system comprises a limiting arrangement to limit the rotation of the head about the post.

In an embodiment, the limiting arrangement comprises a selectable means to limit the rotation of the head about the post to at least one portion of a full rotation.

In an embodiment, the selected partial rotation of the head about the post coincides with the base being in a corresponding partially stabilizing condition.

In an embodiment, the base is associated with a set of drive wheels configured for operation to propel the mobile lifting system.

In an embodiment, each of the drive wheels is associated with a drive wheel carrier including a spring configured to pivot the drive wheel towards the floor surface.

In an embodiment, the mobile lifting system further comprises a wheel motor operable associated with each drive wheel.

In an embodiment, the mobile lifting system further comprises a raising mechanism associated with each drive wheel, the raising mechanism comprising a pivoting arrangement to pivot the drive wheel towards and away from the floor respectively.

In an embodiment, the lifting arm arrangement includes a pair of spaced apart arms extending from a cross-beam pivotably secured to the lifting arrangement with a motor operably coupled with the cross beam to rotate the lifting arm arrangement between the supporting position and the inoperative position.

In an embodiment, the lifting arrangement is operatively coupled to a support structure positioned at a radially off centre location relative to a central longitudinal axis of the post whereby in the supporting position, the lifting arrangement extends transversely relative to the support structure to provide cantilever support to the disabled user supported by the lifting arrangement.

In an embodiment, an in-use lower portion of the support structure is fixedly attached to the post.

In an embodiment, the support structure comprises one or more tracks for engaging a carriage supporting travel of the lifting arrangement along the supporting structure.

In an embodiment, the support structure comprises one or more substantially upright members for supporting the lifting arrangement.

In another embodiment, the support structure extends transversely relative to the post at an angle of less than 90 degrees.

In an embodiment, the body support arrangement is linked to the supporting structure by one or more carrier members extending between the support structure and the body support arrangement.

In an embodiment, the mobile lifting arrangement further comprises a first pivoting arrangement to allow the body support arrangement to pivot relative to the carrier arms between the supporting position and the inoperative position.

In an embodiment, the mobile lifting arrangement further comprises a strut member linked to one or more of the carrier arms for raising or lowering said carrier arms thereby allowing the body supporting arrangement to be moved upwardly or downwardly during use.

In an embodiment, an end portion of the carrier arm travels along a length of the support structure.

In an embodiment, the end portion of the carrier arm is linked to a carriage member arranged to travel along a slot extending along the length of the support structure.

In an embodiment, the body support arrangement comprises a body support mounting hub including one or more electronic devices for facilitating synchronisation of the positions of the body support arrangement with movement of the movable legs of the base.

In an embodiment, the body support mounting hub is attached to a lifting arrangement, the body supporting mounting hub comprising a base frame and a shaft with a mounting arrangement in rotational engagement relative to the shaft, the mounting arrangement allowing the mounting of one or more body supporting structures.

In an embodiment, the mobile lifting system further comprises one or more electrical limit switches positioned relative to the base frame of the body support mounting hub, the switches being positioned to interface with a disc mounted on the shaft such that upon rotating the lifting arrangement through the shaft into the operative position, the limit switches interface with the disc to actuate the movable legs into the stabilizing position and wherein the when the lifting arrangement rotates through the shaft into the inoperative position, the limit switches no longer interface with the disc thereby resulting in the movement of the movable legs into the retracted condition.

In an embodiment, the mobile lifting system further comprises a sensor positioned relative to the shaft and the mounting arrangement for sensing the orientation of the lifting arrangement for assessing if the lifting arrangement is in the supporting position, the inoperative position or in a position in between the supporting and the inoperative position.

In an embodiment, the head and/or the post comprises a stability sensor for measuring vertical stability of the lifting device, the stability sensor being in communication with a processing unit for receiving and processing stability related signals received from the stability sensor in accordance with one or more criteria and transmitting an alarm signal to a remote location when one or more of said criteria in relation to instability are satisfied.

In an embodiment, upon satisfying said one or more predetermined criteria the processing unit communicates with one or more actuating devices to actuate movement of the lifting arm arrangement into the supporting position and/or actuating secondary stabilisation mechanisms to stabilise the base.

BRIEF DESCRIPTION OF THE DRAWINGS

Preferred features, embodiments and variations of the invention may be discerned from the following Detailed Description which provides sufficient information for those skilled in the art to perform the invention. The Detailed Description is not to be regarded as limiting the scope of the preceding Summary of the Invention in any way. The Detailed Description will make reference to a number of drawings as follows:

FIG. 2 C is a perspective view of a lifting device 1, with the base 2 in a stabilizing condition, showing the positions between which the head 5 and lifting arm arrangement 7 may move;

FIG. 4 D-E are schematic plan views of a lifting device 1, with the base 2 shown in a retracted condition;

DETAILED DESCRIPTION OF THE INVENTION

Figure 1A:
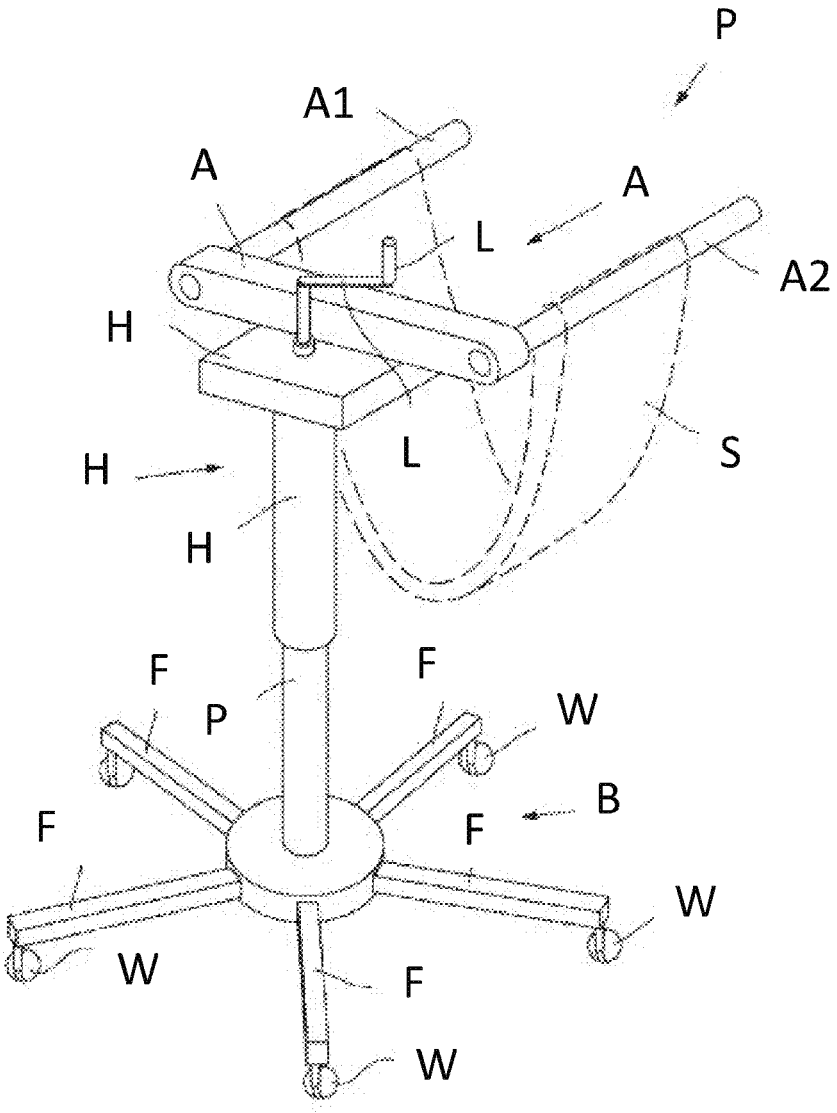
FIGURE 1A (PRIOR ART)
FIG. 1A is a perspective of a prior art lifting device P.
Figure 1:
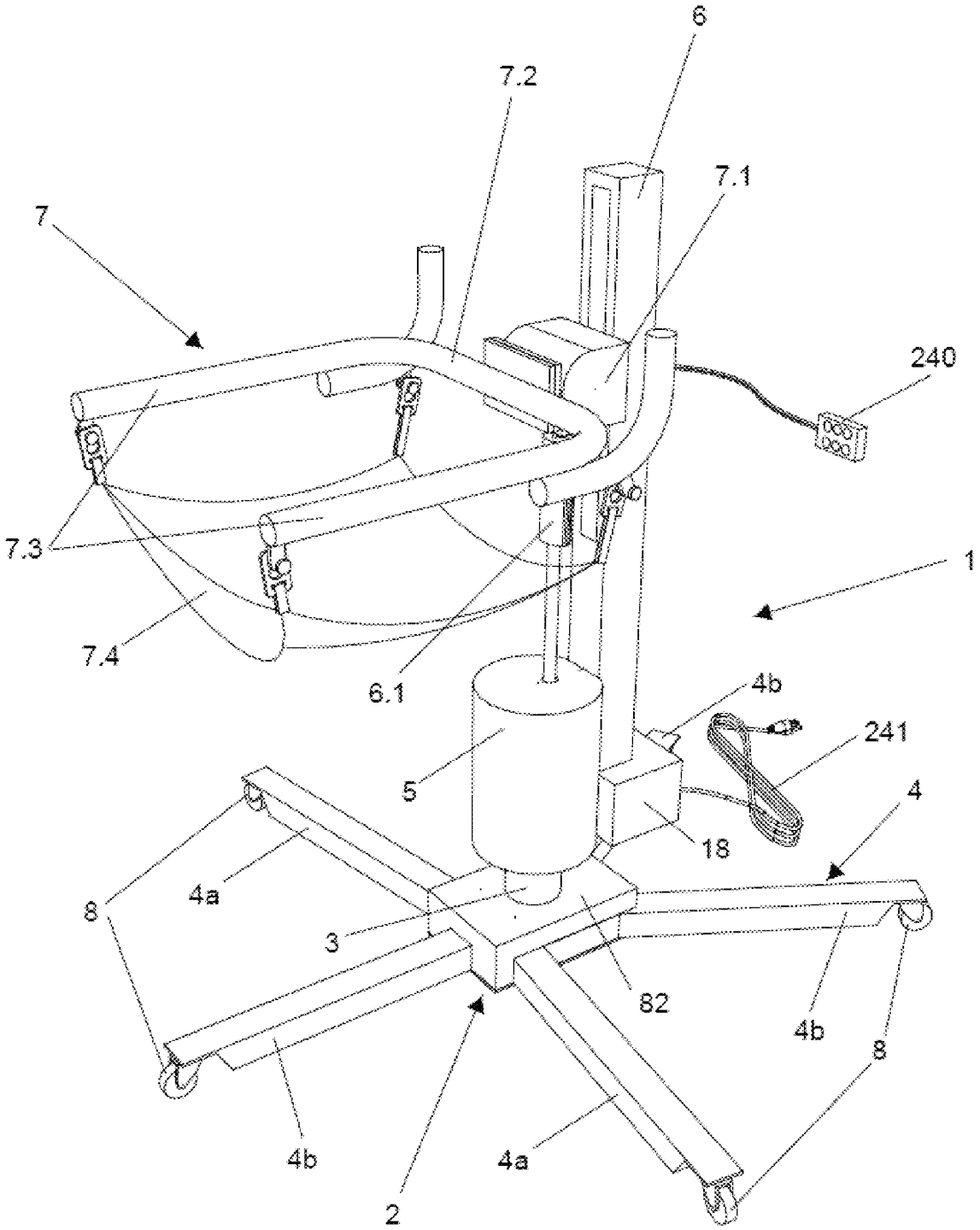
FIG. 1 is a perspective view of a lifting device in accordance with an embodiment.

With reference to the drawings, in which like features are indicated by like numerals, a lifting device or lift is generally indicated by reference numeral 1.

The lift 1 includes a base 2 and a post 3 extending from the base. The base 2 comprises a plurality of legs, generally denoted by 4, which extend substantially laterally from a base housing 82 at the lower end of the post 3. The legs 4 are each provided with a castor wheel 8 at the outer end thereof. In this embodiment, there are five legs 4, which are radially arranged and equally spaced apart with the base 2 expanded in a stabilizing condition as shown in FIG. 1 and FIG. 2A-C.

A head 5 is movably supported by the upper end of the post 3. Attached to the head 5 is a lifting arrangement 6, the configuration of which will vary depending on the mechanisms required for operation of the lift 1. Examples of these are described below.

A body support mounting hub 7.1 is movably supported on the lifting arrangement 6. In this embodiment, the body support mounting hub 7.1 has a body support arrangement 7 attached to it, which includes a pair of spaced apart motorized lifting arms 7.3, which extend from a cross-beam 7.2 that is connected to the body support mounting hub 7.1. A sling 7.4 is removably securable to the lifting arms 7.3, for supporting a person's lower body when using the lift 1.

Figure 2A:
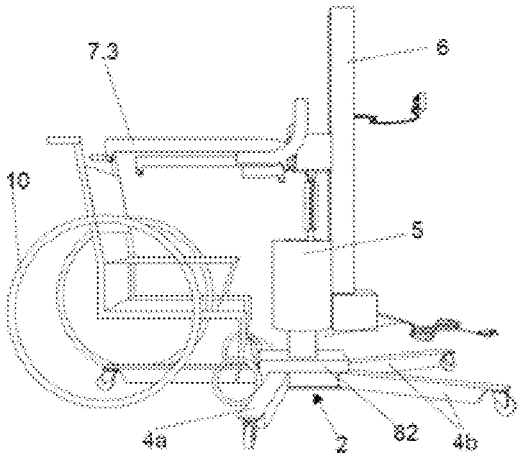
FIGS. 2 A and 2 B are perspective views of a lifting device 1, with the base 2 in a stabilizing condition.
Figure 3A:
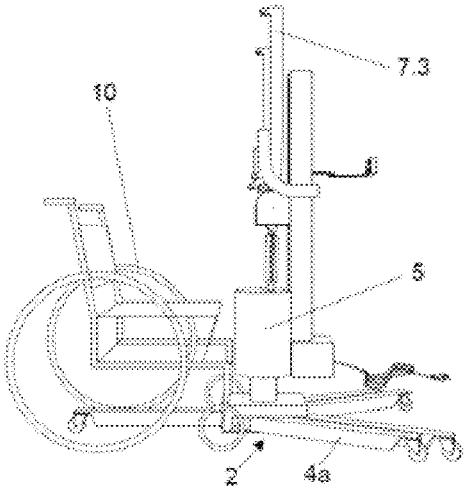
FIGS. 3 A and 3 B are perspective views of a lifting device 1, with the base 2 in a retracted condition.
FIG. 3C is a perspective view of the lifting device 1, with the base 2 in a retracted condition, showing the positions between which the head 5, legs 4*a* and lifting arm arrangement 7 may move.
Figure 2B:
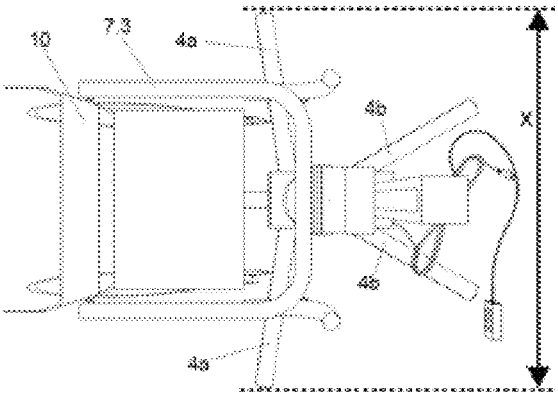
Figure 3B:
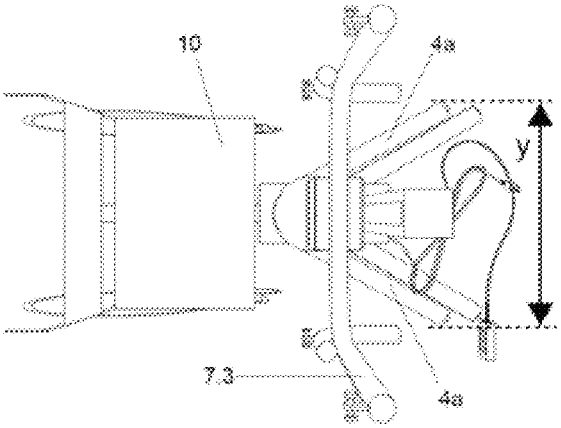
Figure 2C:
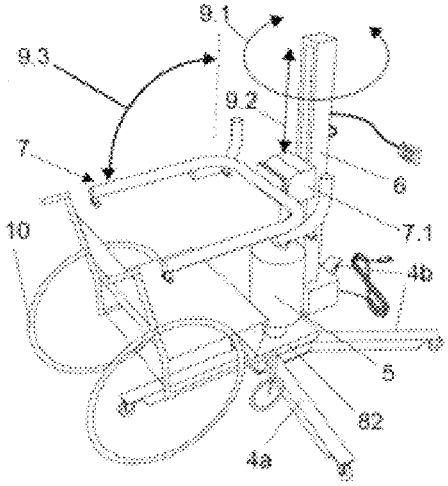
Figure 3C:
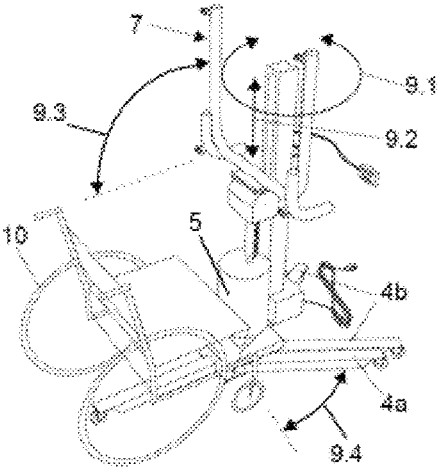

With reference to FIGS. 1, 2A to 2C and FIGS. 3A to 3C, two of the legs 4*a* are movable and the remaining three legs denoted by 4*b* are fixed. The movable legs 4*a* are movable between a stabilizing position, as best illustrated in FIGS. 2A to 2C wherein each leg 4*a* extends radially outwardly from the base 2 to widen the effective width "x" of the base 2, and an inoperative, folded position as best illustrated in FIG. 3A to 3C wherein each of the two movable legs 4*a* is hinged at the base housing 82 towards adjacent fixed legs 4*b*, to decrease the effective width "y" of the base 2. With the legs 4*a* in the latter position, the base 2 is in a retracted condition, this range of movement illustrated by arrow 9.4 in FIG. 3C This operation of the movable legs 4*a* is effected through pivoting of the body support arrangement 7 as described below, to move the base 2 between the stabilizing condition and the retracted condition.

The head 5 is rotatable about the post 3 (as indicated by arrow 9.1 in FIG. 2C, 3C) whilst the body support mounting hub 7.1 is movable upwardly and downwardly in relation to the lifting arrangement 6 (as indicated by arrow 9.2 in FIG. 2C, 3C). The body support arrangement 7 is movable, by pivoting of the mounting flange to which it is connected on the body support mounting hub 7.1, between a weight carrying or supporting position (as shown in FIGS. 1 and 2A to 2C) and an inoperative position (as shown in FIG. 3A to 3C). In the weight carrying position the lifting arms 7.3 extend laterally or horizontally from the lifting arrangement 6, and in the inoperative position the lifting arms 7.3 extend longitudinally or upwardly from the lifting arrangement 6, this movement being best illustrated by arrow 9.3 in FIGS. 2C and 3C.

For the operation described, the device 1 is required to be sufficiently stable or steady so that the person can safely rotate 360° about the post 3. It is further required that the effective width of the lifting device 1 or its base 2 should be small enough for the device 1 to be moved through a narrow width doorway.

These two requirements present an engineering problem in that the stability of the lift 1 whilst rotating would be compromised in the direction of least effective width of a supporting base and it is not practical to increase the effective width of the base to greater than the width of a narrow width doorway. If the width of the base 2 is limited to that of a narrow width doorway, the lifting arms 7.3 would have to be of such a short length that would make it unfeasible or impractical to carry a person in the sling 7.4.

In accordance with embodiments of the current invention, the problem is addressed by having the base 2 movable between the expanded stabilizing condition and the retracted condition. The movable legs 4*a*, which in the stabilizing condition, extend radially outwardly, provide the base 2 of the lifting device 1 with an effective width "x" which is greater than that of a narrow width doorway. Whereas, when the base 2 is moved into a retracted condition with the legs 4*a* folded respectively towards adjacent legs 4*b*, the effective width "y" of the device 1 is smaller than the narrow width of a doorway.

The wheels 8 of the base 2 are arranged substantially equally spaced apart on a diameter about the post 3 when the base 2 is in the stabilizing condition. In this condition, the stability of the device 1 is not compromised in any direction.

The configuration and dimensions of the components for the various mechanisms have been illustrated in the accompanying schematic drawings.

The present technology allows the user who does not have the use of the lower extremities of their body to increase his/her independence, enabling them to transfer themselves between seated positions of varying height and in different locations within the home or facility, e.g. on a bed, sofa, toilet seat, recliner, wheelchair etc., by moving the lift 1 from one location to another by means of a wheelchair 10, without the presence or assistance of another person as best illustrated in FIGS. 1 and 2A to 3C. In an exemplary and non-limiting operating configuration, the user will place himself onto a sling 7.4 whilst seated on a bed, hook the sling 7.4 to the lifting arm arrangement 7 that was lowered into the supporting position which resulted in moving the legs 4*a* into the extended position. These two positions correspond to the stabilizing condition of the base 2, as best illustrated in FIG. 2. The user will then raise himself using the lift. When cleared of the bed, the user will rotate the head 5 about the post 3 of the lift 1 until he is aligned with a wheelchair 10 that was placed next to the lift—typically over the single fixed leg 4*b* between the two folding legs 4*a*. The user will then lower himself onto the wheelchair 10, unhook the sling 7.4 and return the lifting arm arrangement 7 to the inoperative position, thereby retracting the folding legs 4*a*. Once the folding legs 4*a* have been retracted, the lifting device 1 is now in mobile mode and legs 4*a* are in the folded position and the base 2 in the retracted condition, as best illustrated in FIG. 3. The provision of the folding legs 4*a* in the aforementioned configuration, specifically in the folded position, allows the wheelchair 10 to move closer to the post 3 and allow the user to position himself with his wheelchair 10 such that the post 3 is located substantially between their legs (not shown) as indicated in FIG. 3. The user can then push the lift 1 in front of him, using the wheelchair 10 with the lift 1 loosely attached thereto, to a new location and then repeat the process again to be transferred to another seating position, e.g. a lounge chair.

The presently described embodiment provides unassisted usage of the lift 1 by the user in a vast range of locations and seating arrangements inside the house/facility. It is desirable but not essential to provide a relatively level surface to allow a user to easily use the lift 1. The lift 1 strives to allow the user to transfer himself to other seating positions anywhere in the home, even in relatively confined spaces. In addition, this can effectively be done with no other person being present for prolonged periods of time, as the lift can be maintained serviceable. The present technology, offering motorized lifting arms, enables users with limited upper body movement and hand/arm range limitations to operate the lift device without assistance, and the driven and partial rotation functionality allows the user to use the lift device in situations and confined areas that were previously not possible.

Figure 4A:
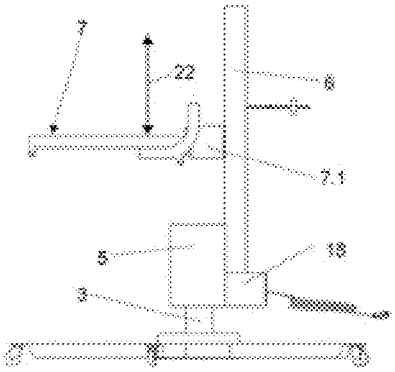
FIG. 4 A-C are schematic plan views of a lifting device 1, with the base 2 shown in a stabilizing condition.
Figure 4B:
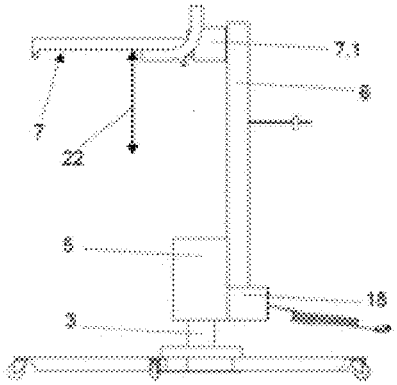
Figure 4C:
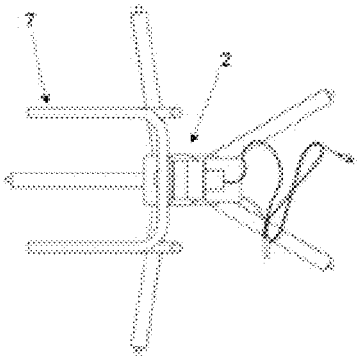
Figure 8A:
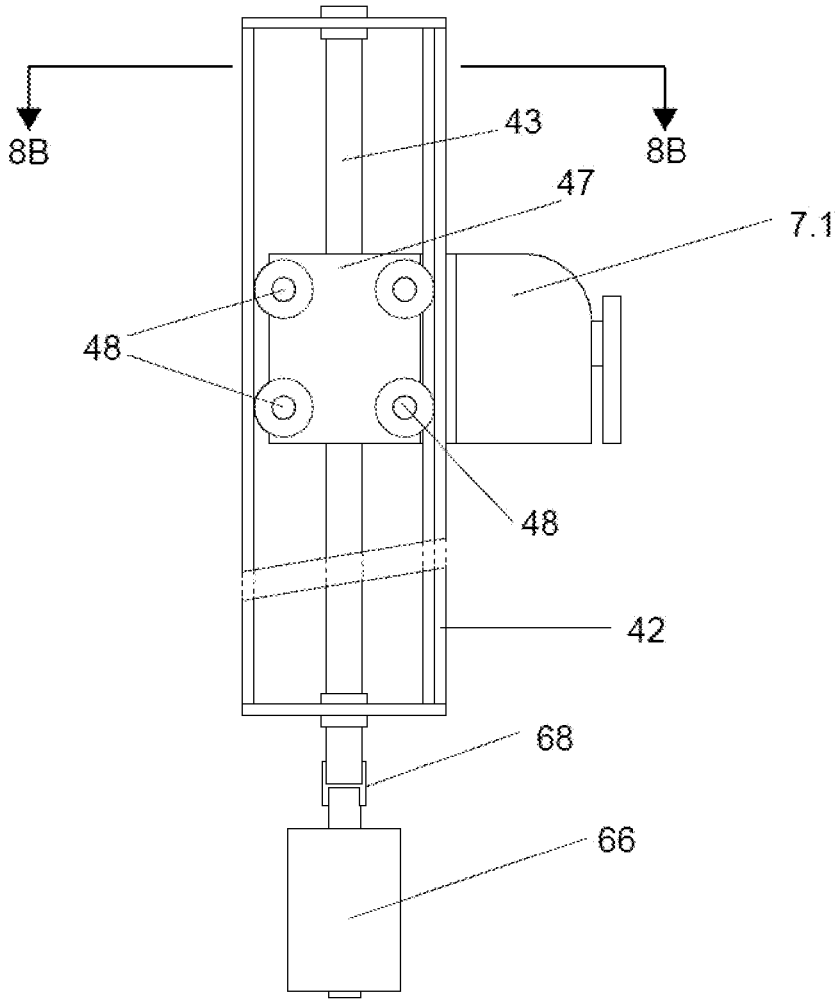
FIG. 8A is a cross-sectional view of a motorized track and carrier assembly for movement of the body support arrangement 7 up and down along the lifting arrangement 6.
Figure 8B:
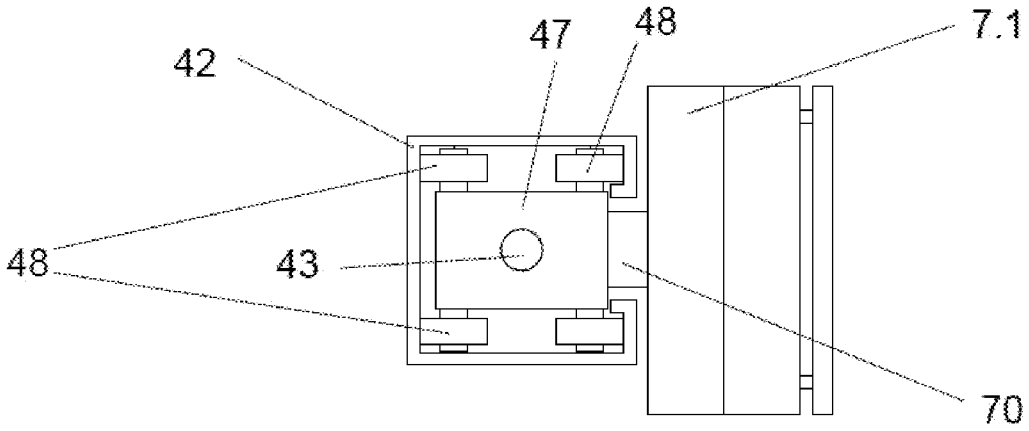
FIG. 8B is a cross-sectional view of the motorized track and carrier assembly taken along line 8B-8B in FIG. 8A.

Some embodiments of the lift 1 can include the body support arrangement 7 being secured to the body support mounting hub 7.1 which is movably supported by the a lifting arrangement 6, which functions as a support structure and allows upwards and downwards movement of the body support arrangement 7, as best illustrated in FIGS. 4A-4B by arrow 22. The lifting arrangement 6 is positioned at a radially offset location relative to a central axis of the post 3. The body support arrangement 7 extends transversely relative to the lifting arrangement 6 to provide cantilever support to the body support arrangement 7. Such an arrangement allows the user (whilst being supported by the supporting arrangement to be positioned closer to the central axis of the post 3 thereby providing more stability to the user during use. In this embodiment, the lifting arrangement 6 is secured at the bottom end to the head 5, and could be in the form of a track 42 containing a carrier assembly 47 to which the body support mounting hub 7.1 is secured, the carrier assembly 47 which includes a ball bearing arrangement 48 to enable it to travel upwards and downwards in the track 42, as best illustrated in FIG. 8A-8B, with the one side of track 42 having been removed in order to show the carrier assembly 47 and associated components inside the track 42. The linkage between the body support mounting hub 7.1 and the base 2 may incorporate electronic componentry to facilitate operation, as described in detail further in this document. The body support mounting hub 7.1 may incorporate electronic switches, which upon sensing motion of the body support mounting hub 7.1, would transmit a signal indicating its position in real time to an electronic control unit. The electronic control unit would then process the signal and in response control the operation of the folding legs 4*a* thereby triggering electronic actuation of the movable legs 4*a* into the stabilized condition for the base 2. Rotation of the head 5 about the post 3 is described in detail further in this document. Upwards and downwards movement of the carrier assembly 47 with body support mounting hub 7.1 secured to it is effected by means of a screw-threaded rod 43 passing through the carrier assembly 47, the screw-threaded rod 43 being rotatably secured at the top and bottom inside the track 42. The carrier assembly 47 includes a central, correspondingly screw-threaded bore causing movement along the screw-threaded rod 43 when the rod is turned. The screw-threaded rod 43 is coupled via a coupling 68 to a drive motor 66 mounted at the bottom of the track 42, and the drive motor is controlled by the electronic control unit 18 that controls all the other electronic functions of the lift.

Figure 5:
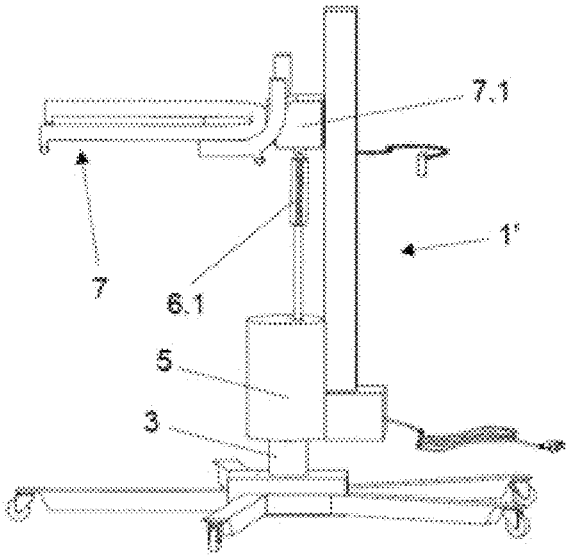
FIG. 5 is a perspective view of a lifting device 1', showing an alternative actuating arrangement 6.1 for lifting the body support arrangement 7.
Figure 4D:
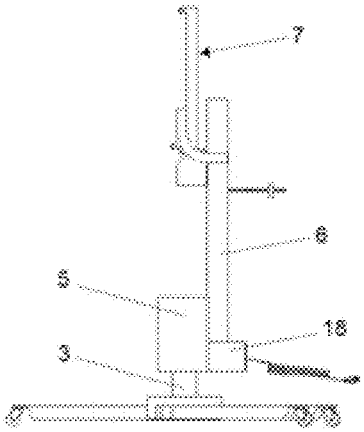

In another embodiment, the screw-threaded rod 43 that is coupled via a coupling 68 to a drive motor 66 to effect lifting and lowering of the carrier assembly 47 can be replaced by a linear actuator 6.1 as best illustrated in FIG. 5. The lower end of the actuator 6.1 is rotatably attached towards the bottom inside the post 3 with the upper end of the actuator being attached to the bottom of the body support mounting hub 7.1.

Figure 6:
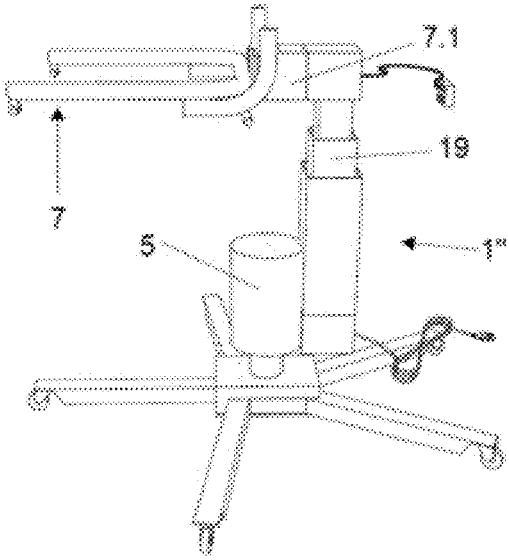
FIG. 6 is a perspective view of a lifting device 1", showing another alternative embodiment with a telescopic post 19 to facilitate lifting of the body support arrangement 7.
Figure 4E:
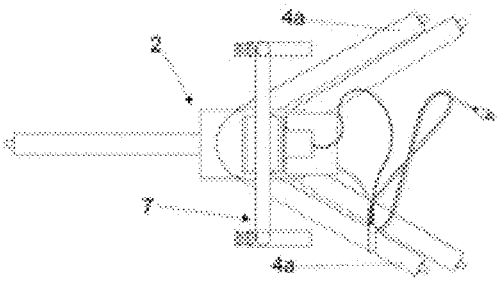
Figures 7A, 7B:
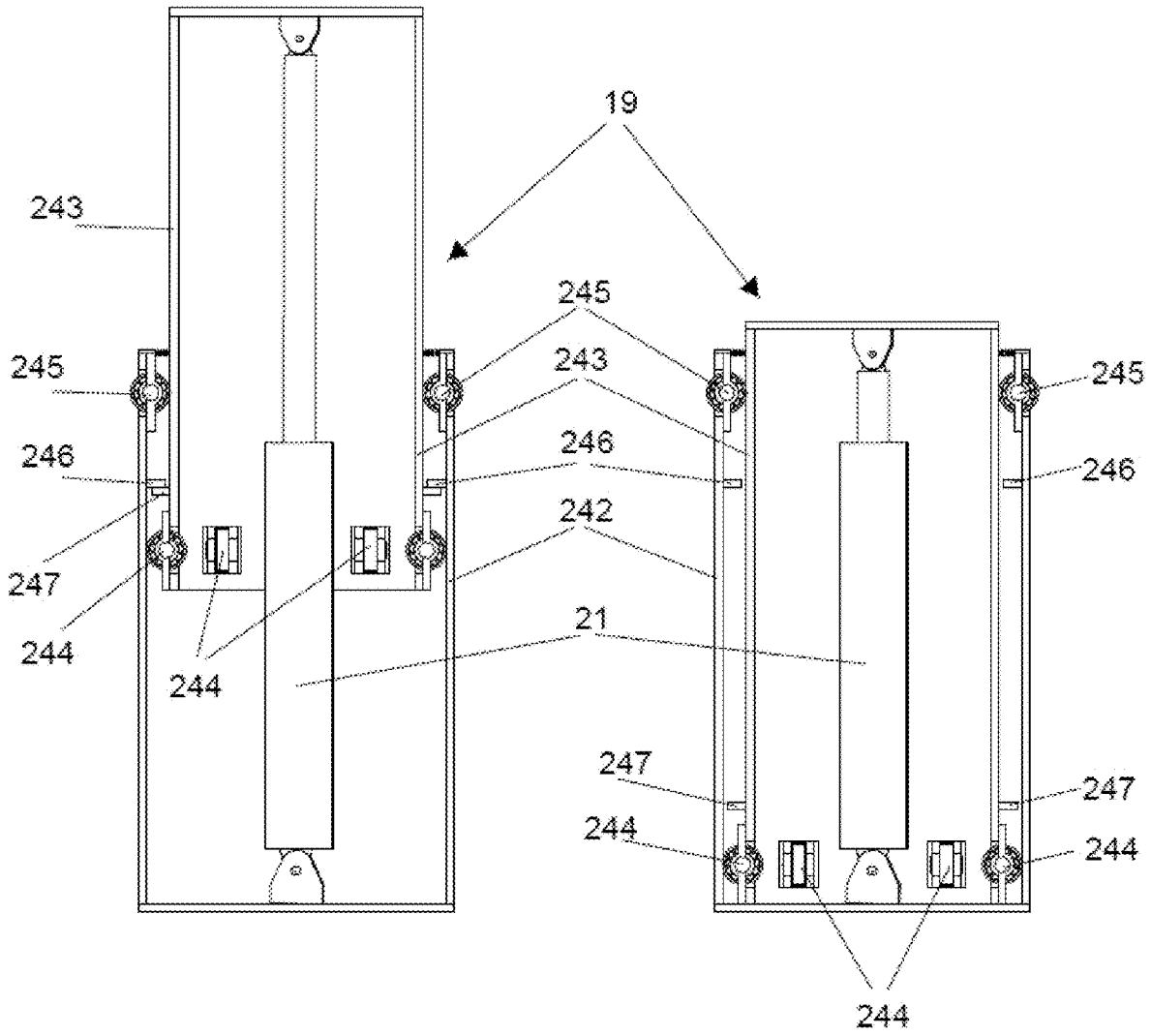
FIG. 7A-B provides schematic cross-sectional views of components of telescopic post shown in FIG. 6.

In another embodiment, the channel 42 and carrier assembly 47 with associated components to create the lifting arrangement 6 can be replaced by a telescopic post 19 which extend to lift the body support mounting hub 7.1 which is attached to the top of the telescopic post 19, which is attached to the head 5 towards the bottom of it as best illustrated in FIG. 6. The telescopic post 19 consists of telescopic section 243, with roller bearing arrangements 244 fixed towards the bottom of it, being of smaller dimensions than telescopic section 242, with roller bearing arrangements 245 fixed towards the top of it, which enables it to slide into and out of telescopic section 242 to extend or shorten the length of the telescopic post 19 as best illustrated in FIG. 7A-B. Mechanical stops 246, 247 fitted to telescopic section 242, 243 respectively prevents the telescopic sections from extending beyond the limit where it will not be able to support the load. An actuator 21 is attached to the inside of the telescopic post 19 to effect lifting and lowering of the body support mounting hub 7.1, being attached to the top of the telescopic post 19. Although only two telescopic sections are shown, the design can be replicated to achieve the desired amount of vertical travel.

Referring to FIGS. 9, 10 and 11A to 11E, an alternative embodiment of a motorized lift device 1''' will be described. All like reference numerals denote like features that have been previously described. In this embodiment, the upwards and downwards movement of a body support arrangement denoted by 7' can be effected by means of a linear actuator 22 which is secured towards the top of the head 5 and at a secondary pivot point 27 of the body support mounting mechanism 24. With the base 2 in the expanded condition, the actuator 23 remains fully retracted causing the rear pivot point 25*a* of body support mounting mechanism 24 to remain at the upper end of the offset channel 26. Lowering and raising of the body support mounting mechanism 24 is achieved by retracting and extending lifting linear actuator 22 respectively, as best illustrated by the arrow 36 in FIG. 11A-B. Changing the position of the body support arrangement 7' between the supportive and inoperative positions is effected by components contained in the track mounted carrier assembly 28 and has been described in further detail in the following sections. Once again it is important to note that the body support mounting mechanism 24 is attached in a cantilevered fashion to a track mounted carrier 33 that travels along offset channel 26. Such a cantilevered arrangement allows the user (whilst being supported by the supporting arrangement 7' to be positioned closer to the central axis of the post 3 thereby providing more stability to the user during use.

One side of the offset channel 26 is fixed to the head 5 and the arrangement includes the linear actuator 23 as well as a track mounted carrier assembly 28 to which the body support mounting mechanism 24 is pivotably secured at point 25*a*. Actuator 23 is secured on one end at the top of the offset channel 26, whilst it is coupled with the track mounted carrier assembly 28 at the other end. When the actuator 23 is fully extended it moves the track mounted carrier assembly 28 towards the bottom of the offset channel 26 which has the effect of lowering the rear pivot point of the body support mounting mechanism 24 as indicated by arrow 38, and when combined with a retraction of actuator 22 causing the body supporting mechanism 24 to go to a lower level than would be required during normal everyday use, for example in the event where a user has to be assisted with getting lifted from a floor level, as illustrated in FIG. 11F.

In order to put the body support arrangement 7 into the inoperative condition and the base 2 into the retracted condition, the body support arrangement 7 may be pivoted into a generally vertical position, either by hand or by motorized means as described elsewhere. A configuration of electric switches, sensors and protrusions, although configured in similar but slightly different way to that of the body support mounting hub 7.1 described elsewhere, transmitting the intention of the user to the control unit for execution, as described elsewhere, and best illustrated in FIG. 11D-E.

Figure 9:
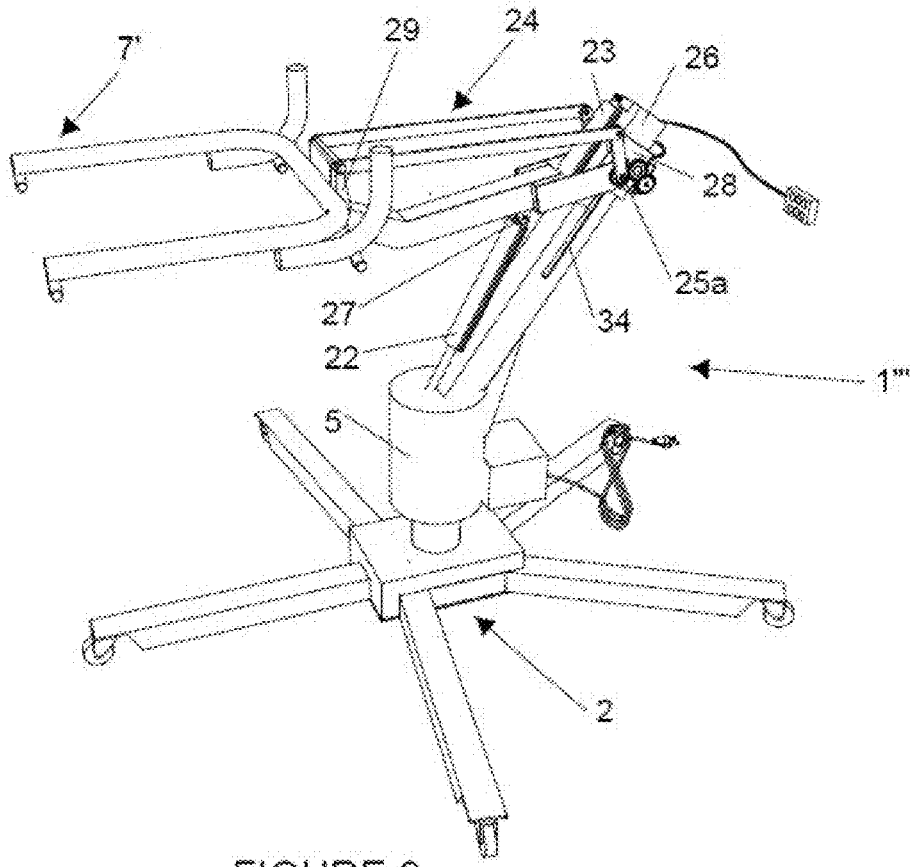
FIG. 9 is a perspective view of an alternative embodiment of another lifting device 1'"
Figure 10:
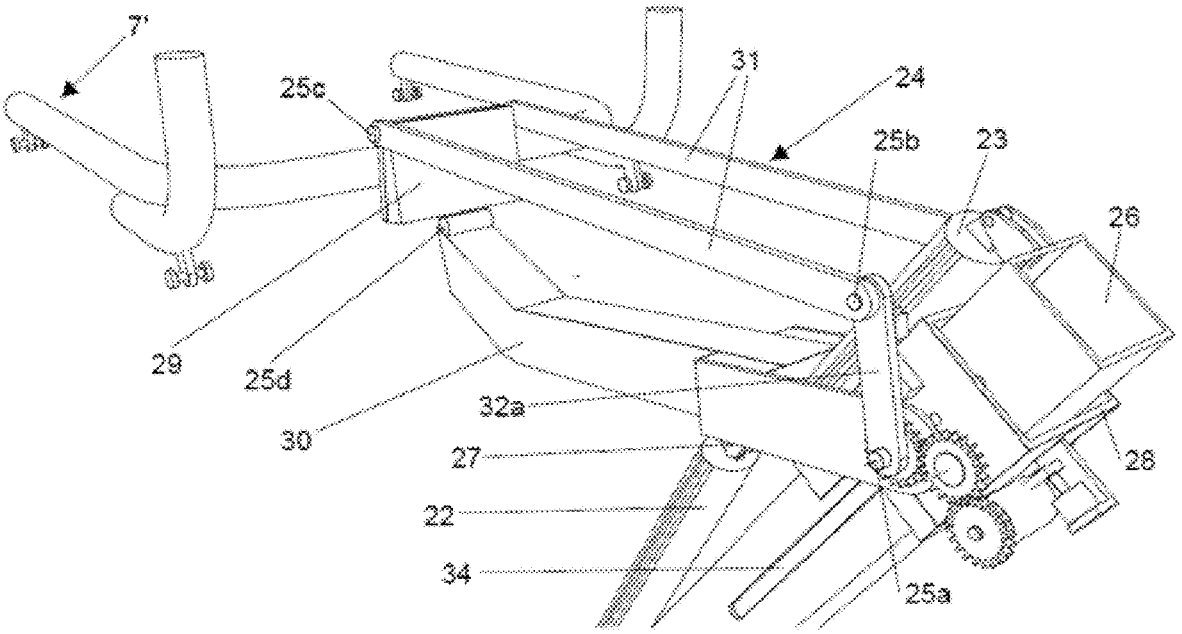
FIG. 10 is a top perspective view of components of the lifting means of the lifting device 1'".

The body support mounting mechanism 24, as illustrated in FIGS. 9 and 10 consists of body support mounting flange 29 with lower carrier 30 and two identical upper carriers 31 hingedly attached to the mounting flange 29, whilst the other ends of carriers 30, 31 are also hingedly attached to levers 32*a* and 32*b*, with the distance between the hinging points 25*c* and 25*d* being identical to the distance between hinging points 25*b* and 25*a*, and the distance between the hinging points 25*c* and 25*b* being identical to the distance between hinging points 25*d* and 25*a*, causing the body support mounting flange 29 to remain at a constant angular orientation to levers 32*a* and 32*b* as the mechanism 24 is raised and lowered by means of a strut actuator 22 which is hingedly attached to the lower carrier 30. The bottom portions of levers 32*a* and 32*b* are hingedly attached at point 25*a* to the track mounted carrier 33 through slot 34 in the offset channel 26 which will allow the mounting point 25*a* to move along the slot when the track mounted carrier assembly 28 travels along the channel. As illustrated in FIG. 12, the track mounted carrier assembly 28 consists of a square tube 28*a* of bigger dimensions than that of offset channel 26 to allow it to slide over the outside of offset channel 26, with track mounted carrier 33 running inside the offset track 26 and fixed to the square tube 28*a* through the slots 34 on either side, allowing the square tube 28*a* and track mounted carrier 33 to move as one along the offset channel 26. The track mounted carrier 33 is of similar design as carrier assembly 47 as previously described and shown in FIG. 8A-B, but without the associated worm gear or threaded rod 43. Mechanical stops 35 attached to square tube 28*a* prevent levers 32*a* and 32*b* from rotating towards the body support arrangement 7 whilst under load, and as such the body support arrangement will remain at a constant inclination in relation to the floor it is being raised and lowered.

Figure 11A:
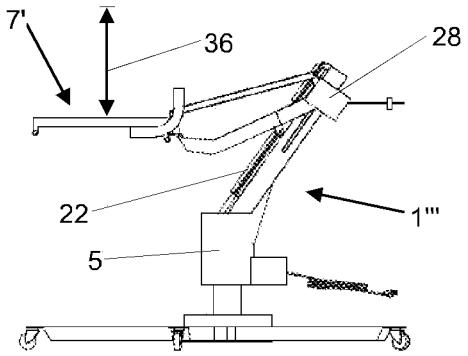
FIG. 11A-C are schematic plan views of the lifting device 1'", with the base 2 shown in a stabilizing condition.
Figure 11B:
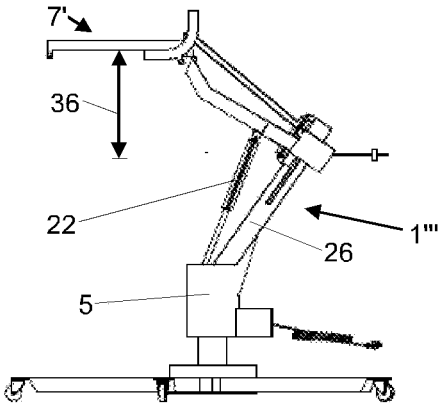
Figure 11C:
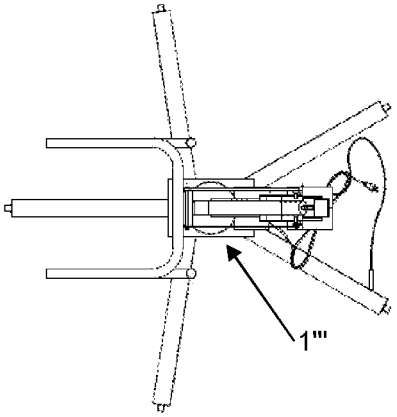
Figure 11D:
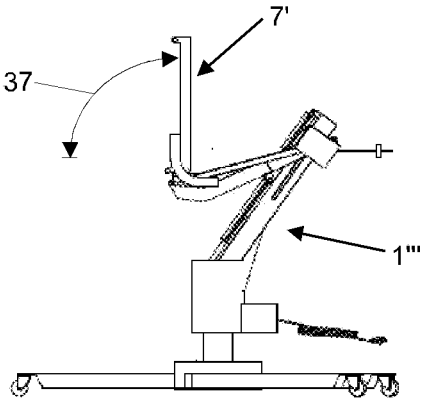
FIG. 11D-E are schematic plan views of the lifting device 1'", with the base 2 in a retracted condition.
Figure 11E:
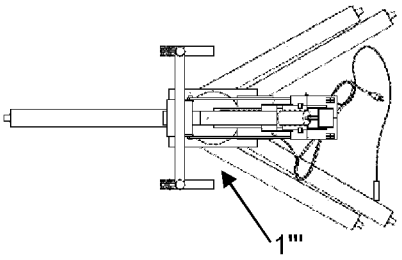
Figure 11F:
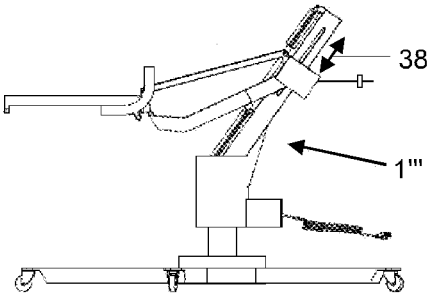
FIG. 11F is a schematic plan view of the lifting device 1'" in the lower supporting position.

As illustrated in FIG. 11D-E, when the body support arrangement 7' is pivoted to a vertical position, as shown by arrow 37, the body support mounting flange 29 rotates through approximately 90 degrees which results in an identical rotation for levers 32*a* and 32*b*. In this condition, the body support arrangement 7' is pivoted into the vertical position in order to render it impossible to be loaded by the user. As explained previously, positioning the body support arrangement 7' also results in the movement of the movable legs 4*a* of the base 2 into a retracted position. In this embodiment, pivoting of the body support arrangement 7', the upwards and downwards movement of body support mounting mechanism 24 and corresponding movement of the legs 4*a* in the base 2 as well as of the rotation of the head 5 about the post 3 may be controlled electronically by means of switches and similar mechanisms, connected to an electronic control unit.

In another embodiment, the track mounted carrier assembly 28 can be fixed directly onto the offset channel 26 towards the top thereof, with the resultant omission of the track mounted carrier 33 and slots 34 from this embodiment, resulting in the rear pivot point 25*a* remaining at a fixed height at all times.

The body support mounting hub 7.1, being a part of the embodiment described in FIG. 1 to 6, contains the components to facilitate synchronization of the positions of the body support arrangement 7 and the legs 4 on the base 2, electronic components to measure loading and vertical stability as well as components for the motorization of the pivoting action to move the body support arrangement between a position where it cannot be loaded when it is in the inoperative condition, to a condition where it can be loaded in the supportive condition, and is best illustrated in FIG. 13A-D. The body support mounting hub 7.1 consists of a base frame 70 which is attached to the carrier assembly 47 along the outside vertical plane, as demonstrated in FIG. 8A-B, whilst supporting a shaft 54 for rotation, a mounting flange 71 being attached to the shaft 54, which facilitates the fitment of a variety of body support arrangements to the body support mounting hub 7.1.

The pivoting action of the body support arrangement 7 has a corresponding impact on the folding legs 4*a* via an electronic linkage. To this end, electrical limit switches may be fitted to a bracket 70.1 which is fixed to the base frame 70 of the body support mounting hub 7.1. The switches 72, 73 interface with a protrusion 74 of disc 75 fitted on the shaft 54 to which the mounting flange 71 is secured. When the body support arrangement 7, which is attached to the mounting flange 71, is in the supporting position as best illustrated in FIG. 4 A-C and FIGS. 13A and 13D, the protrusion 74 engages with the switch 72 which provides an electronic signal to the electronic control unit 18 to reflect this position, which will in turn control operations that can be performed by the lifting device 1 in this operative position. Similarly, when the body support arrangement 7 is lifted and moved towards the inoperative position, the protrusion 74 will no longer engage with the switch 72, which would signal to the electronic control unit 18 that the base 2 should be put into the retracted condition.

When the body support arrangement 7 reaches the upmost or inoperative position as best illustrated in FIG. 4D-E and FIG. 13B-C, the protrusion 74 engages with switch 73 to signal to the electronic control unit 18 that the body support arrangement 7 is in the inoperative position, which will in turn control operations that can be performed by the lifting device in this condition. If the body support arrangement 7 is pivoted away from the inoperative position, the protrusion 74 will no longer engage with switch 73, which would signal to the electronic control unit that the base 2 should be put into the supporting condition. A three-axis accelerometer 76 may be attached to the support between the shaft 54 and the mounting flange 71, which is calibrated with the body support arrangement 7 in the inoperative and supporting positions, and this signal is used by the electronic control unit 18 to sense that the body support arrangement 7 is between the two positions, which in turn would allow the electronic control unit to control operation of the lifting device 1.

Another three axis accelerometer 77 is fitted to the base frame 70 of the body support mounting hub 7.1, which provides electronic signal to the electronic control unit regarding the tilt angle of the lifting device. As tilting and ultimately falling over is one of the biggest risks when operating the lifting device, this information is used by the electronic control unit 18 to raise an alarm, which could be visual or audible, but not limited to this arrangement. In a further embodiment, messaging can be incorporated with the control unit to notify third parties of the alarm. Apart from raising an alarm, the control unit may also be programmed to perform corrective action in certain conditions where the accelerometer 77 senses that the lift is tilting at an angle that exceeds predetermined limits, which may include but not limited to lowering the body support arrangement 7, extending telescopic sections 225 in the legs 4, 4*a* or applying brakes to the lifting device via the drive wheels 92.

Figure 13A:
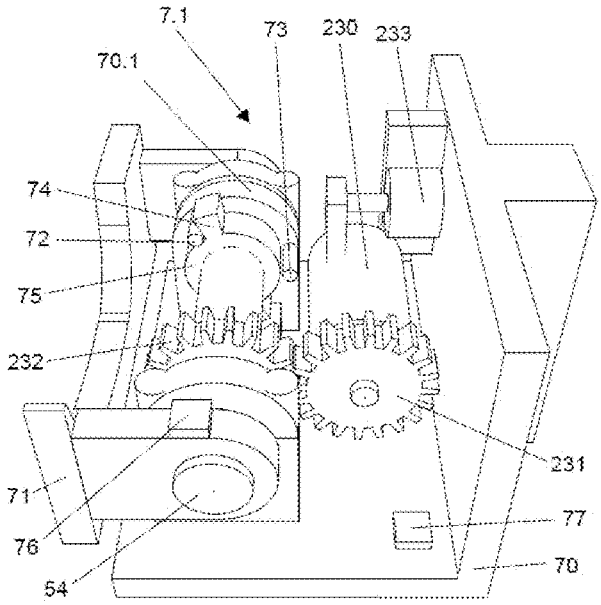
FIGS. 13A-D are perspective views of a body support mounting hub 7.1 which may be suitable for lifting device 1 or lifting device 1' or lifting device 1"
Figure 13B:
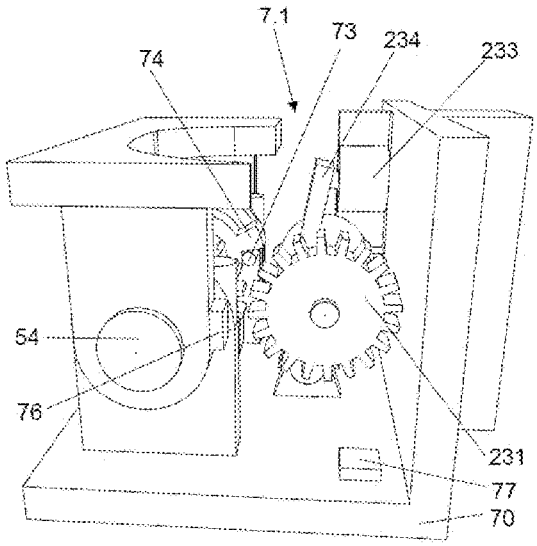
Figure 13C:
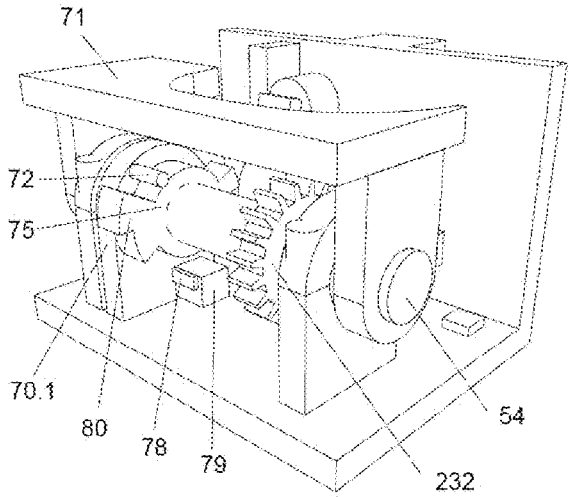
Figure 13D:
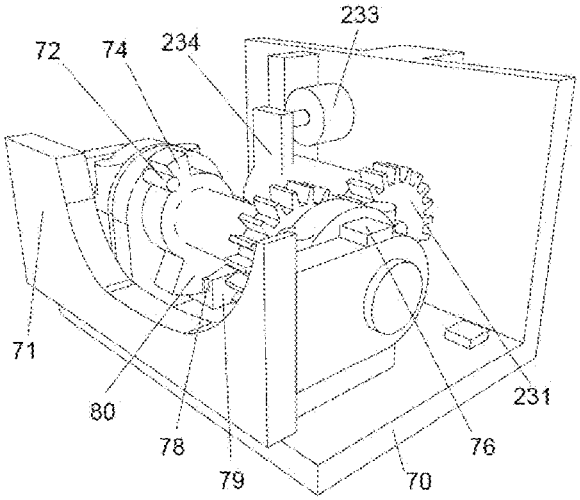

A strain gauge 78 or load cell may be attached to a stopping bracket 79 which is fitted to a bracket 70.1 which is fixed to the base frame 70 in a manner as indicated in FIGS. 13C and D. A load cell is a transducer that is used to create an electrical signal whose magnitude is directly proportional to the force being measured. When the body support arrangement 7 is in the supporting condition, a further protrusion 80 on disc 75 functions as a stop member and abuts against the strain gauge 78 and the load placed on the body support arrangement 7 is translated from an electronic signal produced by the strain gauge and communicated to the electronic control unit. This signal is calibrated to raise an alarm or cause the control unit to perform certain pre-programmed operations when the predetermined safe working load is exceeded, in the event of overloading the lifting device. Actions performed by the lifting device 1 via the control unit may include but is not limited to preventing the body support arrangement 7 to lift the user, or possibly lower the body support arrangement 7 to its lowest supporting level.

In order to improve the ease of use of the lift device 1, especially where users have limited upper body movement and hand/arm range limitations, this embodiment can include the motorization of the pivoting action of the lifting arms arrangement 7 between the supporting and inoperative positions. Referring to FIG. 13A to 13D, an embodiment of the present invention is shown to have motorized arms 7.3. In order to achieve motorization of the lifting arms 7.3, a worm drive motor 230 with spur gear 231 attached to the motor 230 is hingedly mounted on the base frame 70 in a non-engaging default position in relation to spur gear 232. The motor 230 is biased (by a biasing device such as a spring) to be positioned away from the shaft 54 to which spur gear 232 is attached. A solenoid actuator 233 is mounted to the base frame 70 and makes contact with bracket 234 mounted to the outside of the worm drive motor 230. This non-engaging default position is achieved by energizing the solenoid actuator 233 causing it to retract against its own spring bias. Should electrical power be lost, solenoid actuator 233 will be de-energized and extend, causing spur gear 231 to engage with spur gear 232, which will prevent the body support arrangement 7 from being raised or lowered manually, as it will remain in the last safe operating position before power was lost.

In the event where the user would prefer to move the lifting arm arrangement manually between the two positions, the spur gear 231 would by default not be engaged with spur gear 232 and would not impact on this action. In the event where the user would prefer to use the motorized function, the user may select the motorized feature via a remote controller 240 or control switch mounted to the head 5, which will de-activate the solenoid actuator 233, causing it to tilt the worm drive motor 230 towards the shaft 54 which would in turn cause the spur gears 231,232 to engage with each other. When the pivoting action is required, worm drive motor 230 will be energized to rotate the shaft 54 in clockwise or counter-clockwise direction, depending on selection on the remote controller 240, causing the lifting arm arrangement 7 to rotate between the two positions.

It can be appreciated that electronic limit switches can be utilized to ensure that the solenoid 233 is energized and drive motor 230 is switched off once the lifting arm arrangement 7 reached either one of their two final positions.

Figure 12A:
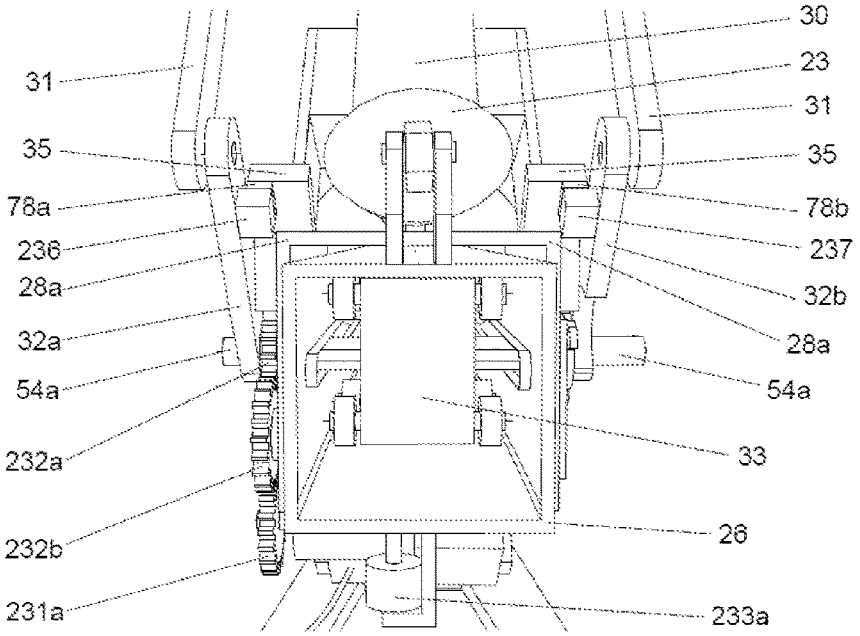
FIG. 12A-C are perspective views of another track mounted carrier assembly suitable for the lifting device 1'"
Figure 12B:
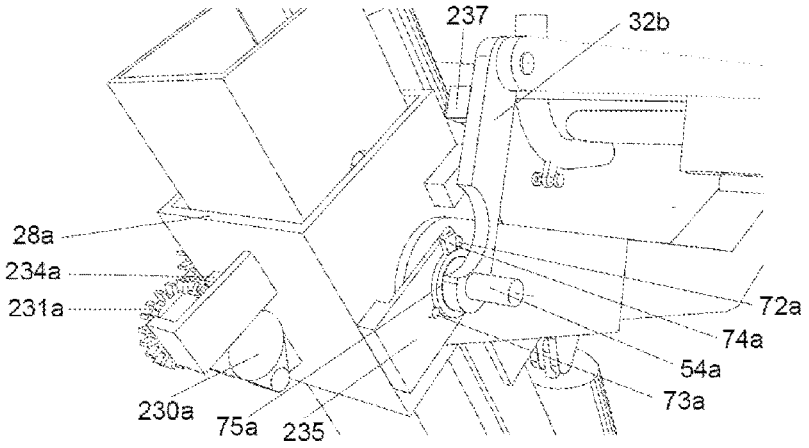
Figure 12C:
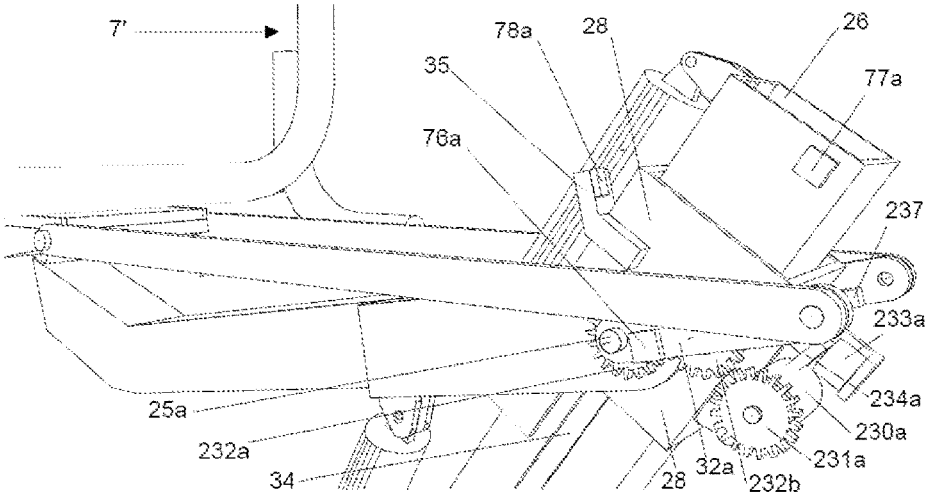

The track mounted carrier assembly 28, being a part of the embodiment described in FIGS. 9 to 11, contains the components to facilitate synchronization of the positions of the body support arrangement 7' and the legs 4 on the base 2, electronic components to measure loading and vertical stability as well as components for the motorization of the pivoting action to move the body support arrangement 7' between a position where it cannot be loaded when it is in the inoperative condition, to a condition where it can be loaded in the supportive condition, and is best illustrated in FIG. 12A-C. The track mounted carrier assembly 28 contains shaft 54*a* which rotatably passes through the square tube 28*a* and track mounted carrier 33 as well as through the slots 34 on either side of offset channel 26, the track mounted carrier 33 containing means in the form of bearings, sleeves or similar means for supporting shaft 54*a* for rotation.

The pivoting action of the body support arrangement 7' has a corresponding impact on the folding legs 4*a* via an electronic linkage as previously described. To this end, electrical limit switches are fitted to a bracket 235 which is fixed to square tube 28*a*, with switches 72*a*, 73*a* interfacing with a protrusion 74*a* of disc 75*a* secured on the shaft 54*a*, to which levers 32*a* and 32*b* are also secured. When the body support arrangement 7', which is hingedly attached to levers 32*a* and 32*b* via upper carriers 31 as previously described in detail, is in the supporting position as best illustrated in FIG. 11 A-C and FIG. 12B, the protrusion 74*a* engages with the switch 72*a* which provides an electronic signal to the electronic control unit 18 to reflect this position, which will in turn control operations that can be performed by the lifting device in this condition. Similarly, when the body support arrangement 7' is lifted and moved towards the inoperative position, the protrusion 74*a* will no longer engage with the switch 72*a*, which would signal to the electronic control unit 18 that the base 2 should be put into the retracted condition.

When the body support arrangement 7' reaches the uppermost or inoperative position as best illustrated in FIG. 11D-E and FIG. 12C, the protrusion 74*a* engages with switch 73*a* to signal to the electronic control unit 18 that the body support arrangement 7' is in the inoperative position, which will in turn control operations that can be performed by the lifting device in this condition. If the body support arrangement 7' is pivoted away from the inoperative position, the protrusion 74*a* will no longer engage with switch 73*a*, which would signal to the electronic control unit that the base 2 should be put into the supporting condition. A three-axis accelerometer 76*a* is attached to lever 32*a*, which is calibrated with the body support arrangement 7' in the inoperative and supporting positions, and this signal is used by the electronic control unit 18 to sense that the body support arrangement 7' is between the two positions, which in turn would allow the electronic control unit to control operation of the lifting device 1'''.

Another three axis accelerometer 77*a* may be fitted to the offset channel 26, which provides electronic signal to the electronic control unit 18 regarding the tilt angle of the lifting device. As tilting and ultimately falling over is one of the biggest risks when operating the lifting device 1''', this information is used by the electronic control unit 18 to raise an alarm, which could be visual or audible, but not limited to this, as messaging can be incorporated with the control unit to notify third parties of the a pre-programmed event that occurred. Apart from raising an alarm, the control unit may also be programmed to perform corrective action in certain conditions where the accelerometer 77*a* senses that the lift is tilting at an angle that exceeds predetermined limits, which may include but not limited to lowering the body support arrangement 7', extending telescopic sections 225 in the legs 4, 4*a* or applying brakes to the lifting device via the drive wheels 92.

Two strain gauges 78*a*, 78*b* are attached to mechanical stops 35. When the body support arrangement 7' is in the supporting condition, mechanical stops 236 and 237 which forms part of levers 32*a* and 32*b* respectively, abuts against strain gauges 78*a* and 78*b* respectively, and the load placed on the body support arrangement 7' is translated from electronic signals produced by the strain gauges and communicated to the electronic control unit. This signal is calibrated to raise an alarm or cause the control unit to perform certain operations when the predetermined safe working load is exceeded, in the event of overloading the lifting device. Actions performed by the lifting device via the control unit may include but is not limited to preventing the body support arrangement 7' to lift the user, or possibly lower the body support arrangement 7' to its lowest supporting level.

In order to improve on the ease of use of the lift device 1', especially where users have limited upper body movement and hand/arm range limitations, this embodiment can include the motorization of the pivoting action of the body support arrangement 7' between the supporting and inoperative positions. In order to achieve this, a worm drive motor 230*a* with spur gear 231*a* attached to it is hingedly mounted on square tube 28*a* in a non-engaging default position in relation to idler spur gear 232*b*, which is permanently engaged with spur gear 232*a* and which is secured to shaft 54*a*, as it is biased (by a biasing device such as a spring) to be positioned away from the spur gear 232*b*. A solenoid actuator 233*a* is mounted on a bracket secured to square tube 28*a* and makes contact with bracket 234*a* mounted to the outside of the worm drive motor 230*a*. This non-engaging default position is achieved by energizing the solenoid actuator 233*a* causing it to retract against its own spring bias. Should electrical power be lost, solenoid actuator 233*a* will be de-energized and extend, causing spur gear 231*a* to engage with spur gear 232*b*, which will prevent the body support arrangement 7' from being raised or lowered manually, as it will remain in the last safe operating position before power was lost. and is illustrated in FIG. 12C.

In the event where the user would prefer to move the body support arrangement 7' manually between the two positions, the spur gear 231*a* would by default not be engaged with idler spur gear 232*b* and would not impact on this action. In the event where the user would prefer to use the motorized function, he will select this via the remote controller 240 or control switch mounted to the head, which will de-activate the solenoid actuator 233*a*, resulting it to tilt the worm drive motor 230*a* towards shaft 54*a* which would in turn cause the spur gears 231*a*, 232*b* to engage with each other, as illustrated in FIG. 12B. When the pivoting action is required, worm drive motor 230 will be energized to rotate the shaft 54*a* in clockwise or counter-clockwise direction, depending on selection, causing the body support arrangement 7' to rotate between the two positions.

It can be appreciated that electronic limit switches can be utilized to ensure that the solenoid 233*a* is energized and drive motor 230*a* is switched off once the body support arrangement 7' reached either one of the two final positions.

In some embodiments, the present technology can be self-driven by remote control. This feature allows the lift 1 to move from one position to another under its own power.

One aspect of the present invention is to provide users with independence, and it would be beneficial to recharge the batteries required for electronic operation on a regular basis. Electrical power is typically required to operate the charging circuitry, and to this end the lift 1 has to be placed in a position where a power socket or charging station can be accessed to connect power cable 241.

In order to achieve this type of mobility, a set of wheels 92 of small diameter are pivotally mounted to the base housing 82, or a mounting thereof, of the lift 1, as illustrated in FIGS. 14A, 14B, 15A to 15C and 16A to 16C. The wheels 92 may be aligned towards a similar direction, mounted spaced apart and parallel to each other, and may be operated independently, by remote control, in forward and reverse rotational directions and at varying rotation speeds. Such an arrangement allows the lift 1 to be maneuvered with precision, even in confined spaces. The wheels 92 may be driven by a worm drive interface with a small electronic motor 90, such as but not limited to, a worm drive motor or right angle drive motor. The worm drive interface allows the wheels 92 to be used as a brake when the no electrical power is supplied to the motor.

The drive wheels 92 may be lowered and raised depending on the requirement of the user. When the drive wheels 92 are required to maneuver the lift 1 for charging or storing out of reach, or when the user is operating the lift 1 on a small incline and requires the lift to remain stationary, the drive wheels 92 can be lowered manually, mechanically or electronically to make contact with a floor F.

Figures 15A, 15B, 15C:
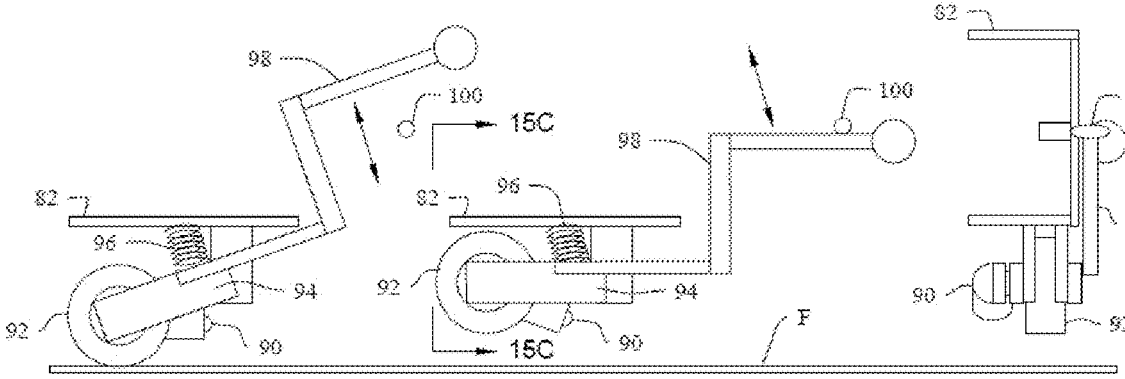
FIG. 15A-C are plan views of a manually operated wheel raising arrangement suitable for use with mobile lift 1, 1', 1" or 1'", with FIG. 15C being a front plane view taking along line 15C-15C in FIG. 15B.

When the user is moving the lift 1 with the use of his wheelchair, the drive wheels 92 can be raised to avoid contact with the floor F, as best illustrated in FIGS. 15B and 15C. Another application where drive wheels 92 can be raised is when a family member or caregiver is present and would like to move the lift 1 by hand whilst the user is being supported by the lift.

In another embodiment, the capacity of the electronic motors 90 driving the drive wheels 92 as well as the contact surface area of the wheels 92 may be increased to allow the user to move the lift 1 using the drive wheels 92, whilst being supported by the lift 1. A typical application would be where space is limited and it would be too difficult to have both the wheelchair and the lift in the space, such as but not limited to, in a bathroom or water closet.

The drive wheels 92 can typically be in a default lowered position, with manual override (FIGS. 15A-15C) or electrical power (FIGS. 16A-16C) required to raise them. The wheel assembly can also be spring loaded using a spring 96 to ensure optimal contact with the floor surface F when an uneven or undulating surface is encountered.

The means by which the drive wheels 92 are controlled may be selectable and only one option can be selected at a time to avoid uncontrolled/accidental activation of the drive wheels.

Connectivity options for the purpose of controlling the drive wheels may include but not be limited to a controller/application wirelessly connected via Smartphone/Radio remote control or Bluetooth link to control circuitry or physical remote control 240 connected to control circuitry via cable.

In some embodiments, a manual override option can be provided where a caregiver or family member would like to push the lift 1 with the user being supported for short distances, or push the lift out of the way when the base 2 is in the retracted condition. The lift 1 may be configured in that manual override can be selected with the base 2 being in the stabilized or retracted conditions, but the base 2 would be prevented from going from the retracted condition to the stabilized condition whilst the manual override is selected. This can be achieved by interlock switches incorporated on the manual override mechanism of the drive wheels 92 to sense when wheel is retracted. The reason for this interlock functionality being provided is to prevent the lift 1 being used by the user to support himself from an unsupported position whilst the drive wheels are manually overridden, which will disable maneuverability and more critically braking.

Manual override, as best illustrated in FIGS. 15A-15C, can include the manual raising of the drive wheels 92. This can be achieved by pushing down an override lever 98, attached to the wheel carrier 94, and hooking it over a protrusion 100 extending from the side of the base housing 82. This protrusion 100 can also be or include an electric switch, which serves as an interlock switch preventing the base 2 from going from the retracted condition to the stabilized condition whilst the manual override is selected. This manual override configuration is the same for both drive wheels. This manual override lever 98 is visible and accessible on the outside of the base housing 82.

The wheel carrier 94 is pivotably mounted to the base housing 82 or a mounting thereof. The spring 96 is configured to force the wheel carrier 94 to pivot so that the wheel 92 is in contact with the floor F, consequently placing the lever 98 in a raised position. To the raise the wheels 92 off the floor F, the user could press or step down on the portion of the lever 98 that is accessible outside the base housing 82, which would pivot the wheel carrier 94 towards and against the force of the spring 96. Releasing the lever 98 would automatically lower the wheels 92.

Figure 16A:
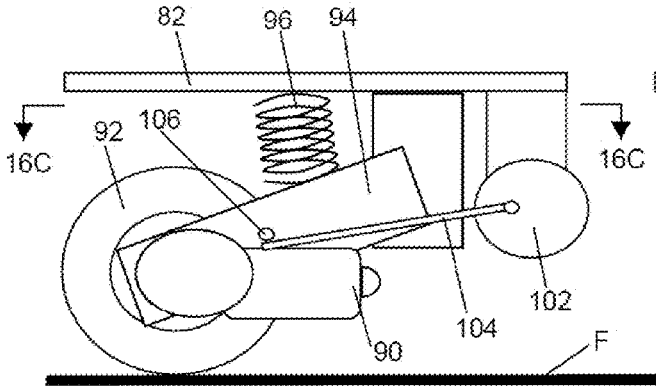
FIG. 16A-C are plan views of a motorized wheel raising and lowering arrangement suitable for use with mobile lift 1, 1', 1" or 1'", with FIG. 16C being a top elevational view taking along line 16C-16C in FIG. 16A.
Figure 16B:
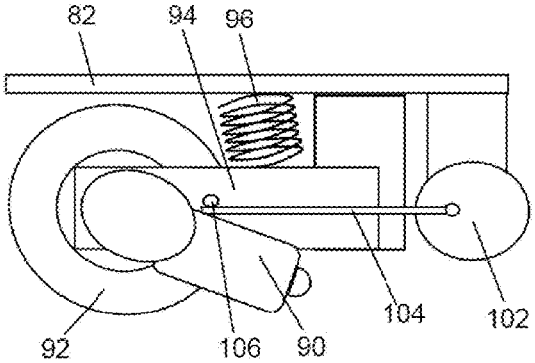
Figure 16C:
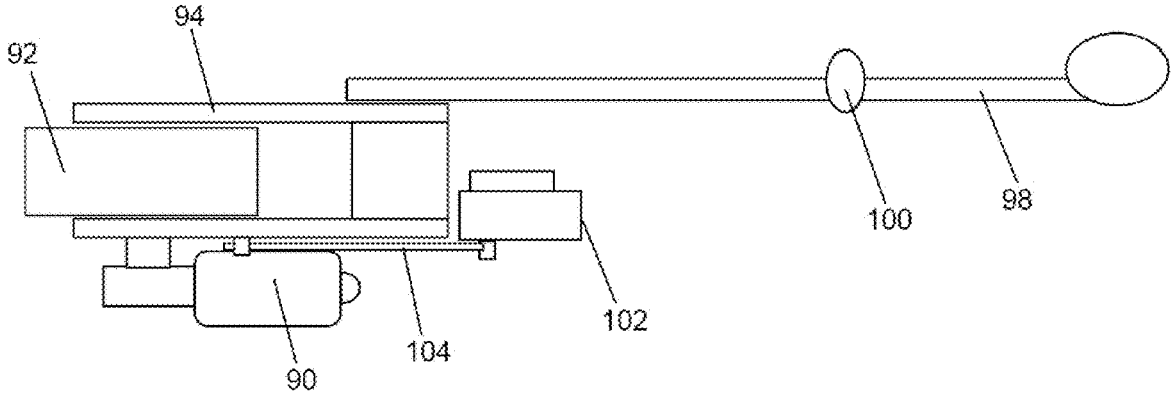

In some embodiments, as best illustrated in FIGS. 16A-16C, the manual override lever can take the form of a linkage lever 104 that can be operated by a stepper motor 102 mounted to the base housing 82 or a mounting thereof. A linkage, disc or wheel can be operably attachable to the shaft of the stepper motor 102. On end of the linkage lever 104 can be operably coupled to the linkage part of the motor 102 in an offset arrangement from a longitudinal axis of the stepper motor shaft. An opposite end of the linkage lever 104 can be engageable with a protrusion or mount 106 of the wheel carrier 94.

Rotation of the stepper motor 102 results in translational movement of the linkage lever 104, which consequently rotates the wheel carrier 94 about its pivot point thereby lifting the wheel assembly off the ground against the biasing force of the spring 96.

Figure 17A:
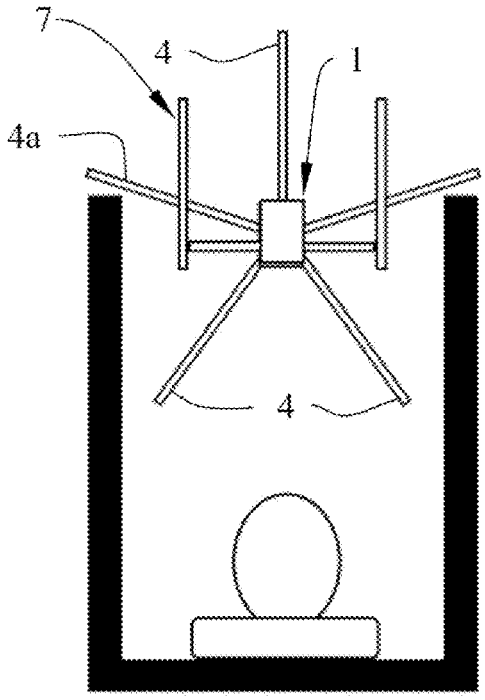
FIG. 17A-E are top schematic view of the folding legs in a variety of configurations suitable for use with mobile lift 1, 1', 1" or 1'"
Figure 17B:
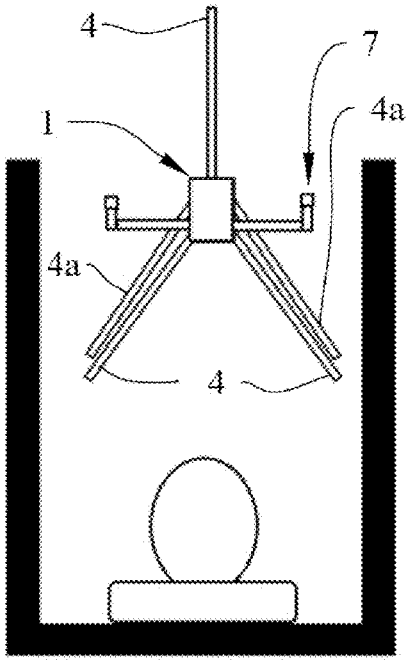

An operational feature of the present embodiment is partial rotation capability of the lift 1. This feature can be utilized where the lift 1 may be required to be used in an area with limited space. An example of which, as best illustrated in FIG. 17A-17E, is the utilization of the lift 1 in a water closet/bathroom, where the user would not be able to use the facility as the lift's footprint would be too wide to fit between the walls if it is in the full stabilizing condition per FIG. 17A. With the lift 1 in the retracted condition shown in FIG. 17B whereby the movable legs 4*a* are folded towards the fixed legs 4*b*, it may enter the water closet/bathroom, but there is insufficient space to put the base into the stabilizing condition, as illustrated in FIG. 17B. The selective rotation feature may allow the user to enter the water closet with the base 2 in the retracted condition, and then select partial rotation option, which will cause the base 2 to be expanded on the one side only by extending only one of the movable legs 4*a*. As the lift 1 is not in the stabilizing condition to allow full rotation of the head 5 and attached body support arrangement 7 about the post 3, rotation is limited to a predefined angle, for example, approximately 150°, by means of physical discs mounted on the post, with associated mechanism, as further described below and illustrated in FIG. 17C-17E. Another optional way of utilizing the partial rotation feature is to select the partial rotation option prior to entering the water closet, and then use the drive wheels 92 to move the lift 1 into the water closet whilst the user is being supported by the lift 1.

The partial rotation can be selected for one side at a time, and the lift 1 is still put into this partial stabilizing condition by lowering the body support arrangement 7 into the supporting condition. An interlock prevents the partial rotation mode being changed once the lift 1 is in the stabilizing condition. This function may also conserve energy as an added benefit, as only one side of the base is expanded.

Figure 18A:
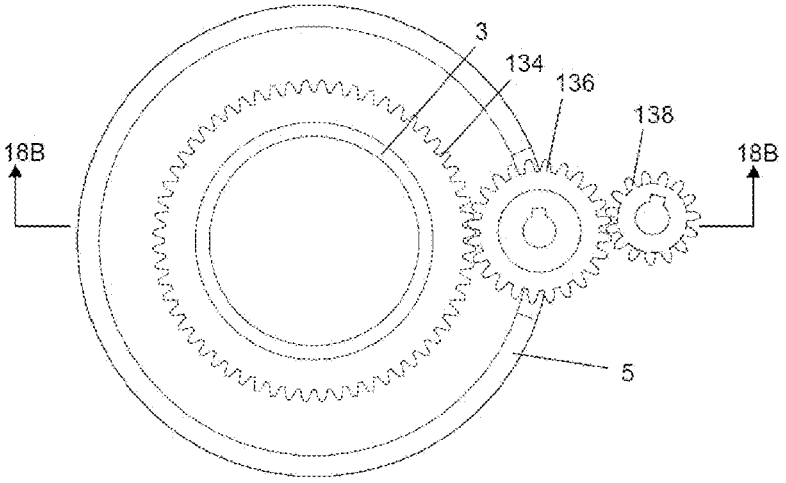
FIG. 18A is a top cross-sectional schematic view of the worm drive motor assembly and ring gear interface taken along line 18A-18A shown in FIG. 18B suitable for use with mobile lift 1, 1', 1" or 1'"

In the exemplary, with reference to FIGS. 18A, 18B, 19A, 19B and 20A-20C, there may be four modes of rotation of the head unit 5 about the post 3:

Full Driven Rotation—Rotation through 360° about the post 3 may be effected by a worm drive motor 140 coupled to a ring gear 134 mounted on the post 3 and best illustrated in FIGS. 18A and B. The head 5 is rotatably fitted to the post 3 by using two taper roller bearings 180, 181. These bearings 180, 181 are biased towards radial forces during rotation of the head under load, and at the same time will carry the head 5 to which the lifting mechanisms and body support arrangement are attached to. Rotation of the head 5 unit about the post 3 is achieved by securing the ring gear 134 on the post 3 between the two taper roller bearings 180, 181 and driving this with the worm drive motor assembly 140 or similar, which is attached to the head unit where accessible to the user when supported by the body support arrangement.

Full Free Rotation—Rotation through 360° about the post 3 effected by manually pushing/rotating the head unit 5 about the post 3 as the worm drive motor 140 is manually disengaged. A worm drive motor 140 can be used to effect rotation, which is hingedly mounted on the head unit 5 and interfaces with the ring gear 134. The worm drive motor 140 is capable of being manually disengaged to allow free rotation by manually pushing/rotating the head unit about the post, when lift is in stabilizing condition. The mechanism is interlocked when the lift 1 is not in this condition, which will prevent the drive motor from being disengaged to effect free rotation.

Figure 17C:
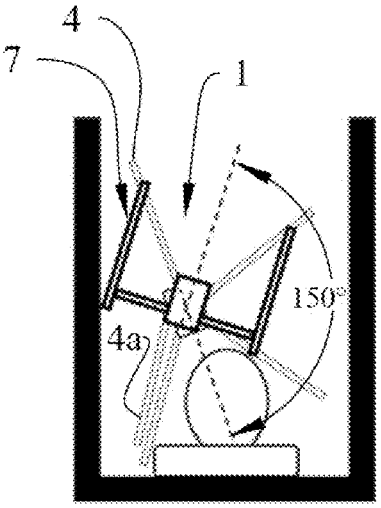
Figure 17D:
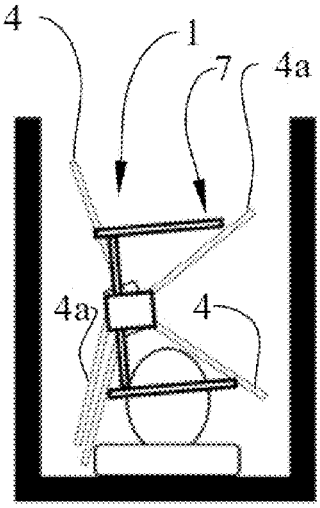
Figure 17E:
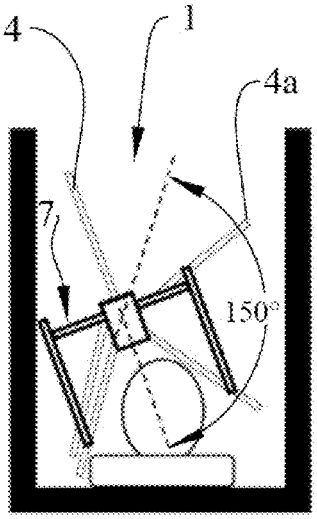

Partial Driven Rotation—Rotation about the post 3 is effected by the worm drive motor 140 and ring gear arrangement 134, but it is limited to a predefined angle, for example, approximately 150°, per side in order to prevent the body support arrangement 7 to rotate over the section of the base 2, which is not in the stabilizing condition, as best illustrated in FIG. 17C-17E. In FIG. 17C, the body support arrangement 7 is in its most counter clockwise position. It is able to rotate clockwise over the section of the base 2 that is in the stabilizing condition, until the body support arrangement 7 reaches the most clockwise position as illustrated by FIG. 17E.

Partial Free Rotation—Rotation about the post 3 is effected by manually pushing/rotating the head unit 5 about the post as the worm drive motor 140 is manually disengaged, but it is limited to a predefined angle, for example, approximately 150°, per side in order to prevent the body support arrangement 7 to rotate over the section of the base 2, which is not in the stabilizing condition.

Figure 18B:
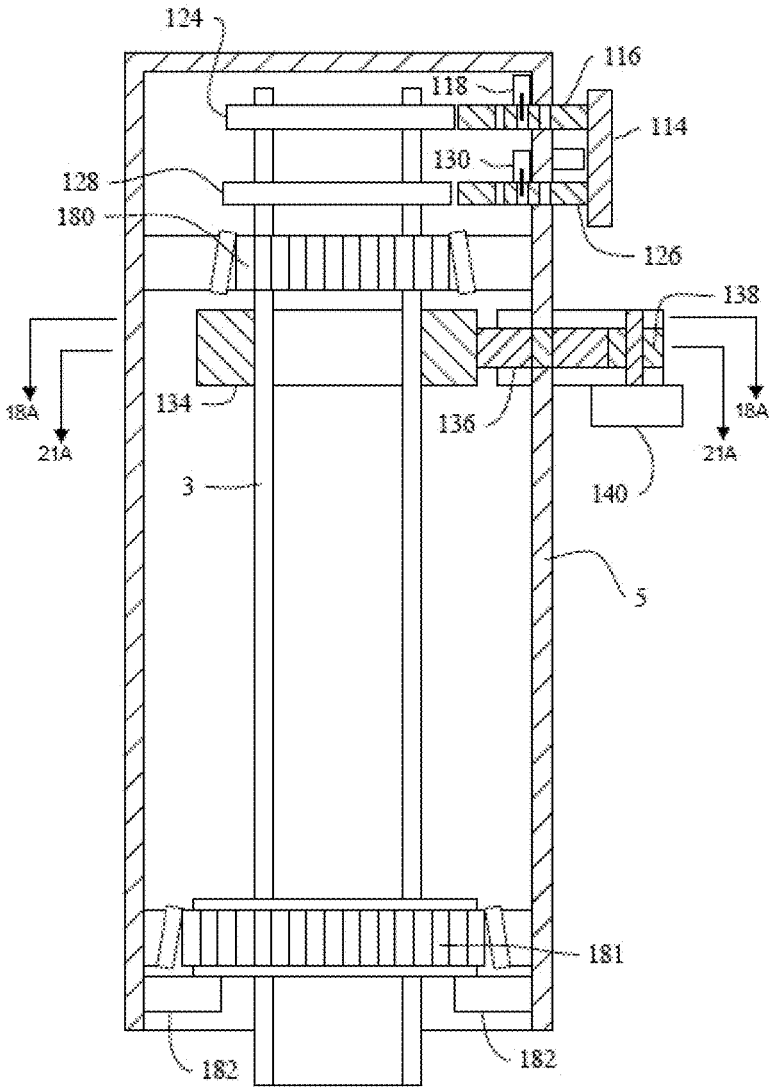
FIG. 18B is a side cross-sectional schematic view of head unit taken along line 18B-18B shown in FIG. 18A.
Figure 19A:
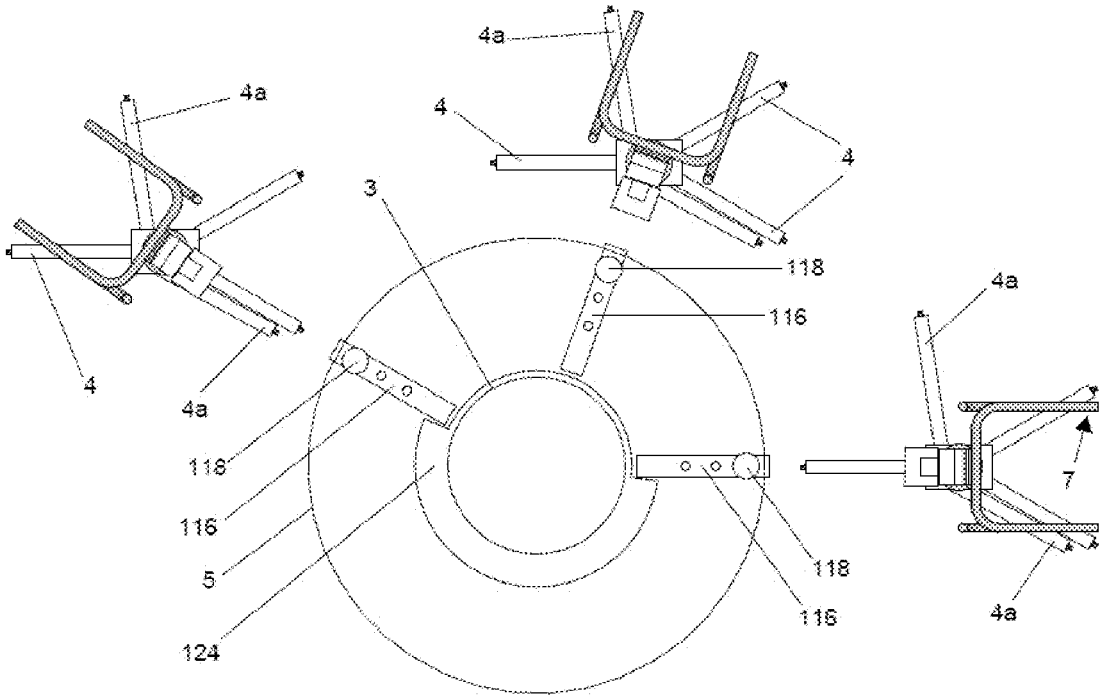
FIG. 19A-B is a top elevational schematic view of the discs and push rods associated with the motorized head unit in varying operational states with corresponding folding leg configurations suitable for use with mobile lift 1, 1', 1" or 1'"
Figure 19B:
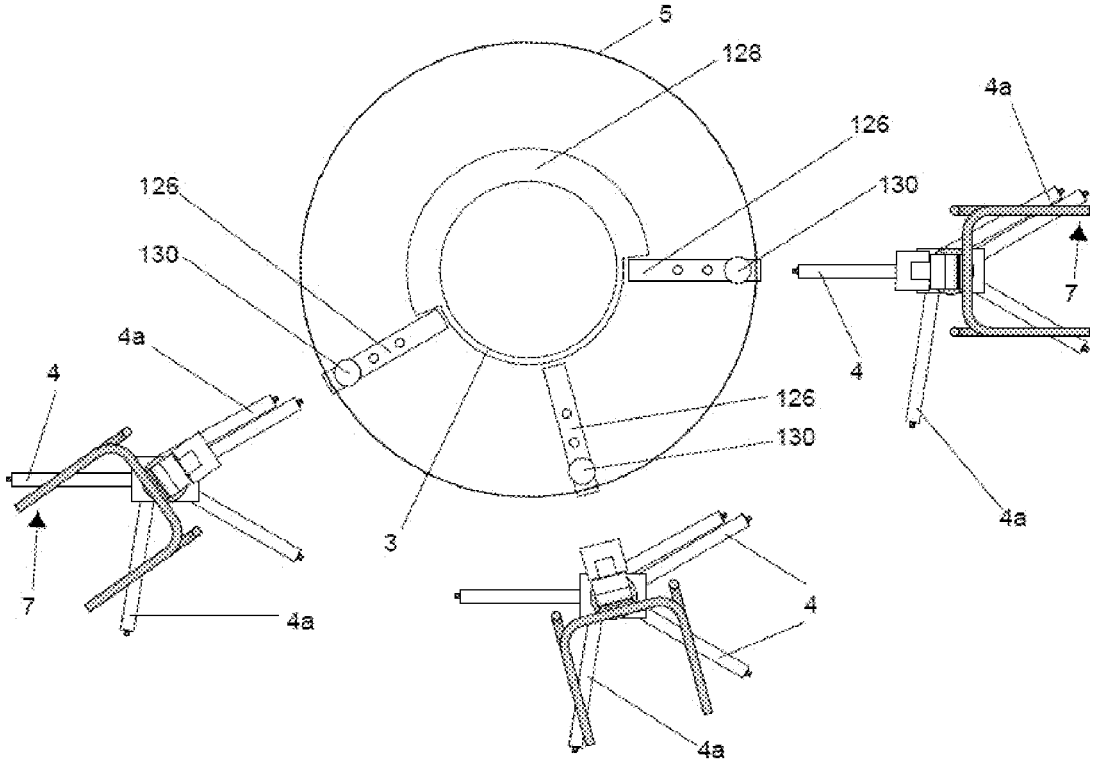

A mechanism that can be used to achieve the partial rotation feature can include two discs 124, 128 mounted above the top taper roller bearing 180, as best illustrated in FIG. 18B. The discs 124, 128 can be mounted in the cavity between the post 3 and the head 5, and the discs 124,128 can include removed or notched sections. This mechanism can include a pivotable or pushable rotation selection lever 114 that interacts with a pair of push rods 116, 126, each of which define a plurality of holes. Each push rod 116, 126 is also associated with a corresponding solenoid 118, 130 that can engage with at least one of the holes, respectively. Ends of the push rods 116, 126 are engageable with the removed or notched section of their corresponding disc 124, 128.

These discs 124, 128 can be mounted to the post 3 in an orientation as shown in FIG. 19, with the orientation of the body support arrangement 7 shown as it rotates about the post whilst also illustrating the orientation of the foldable legs 4*a* corresponding to its disc selection and position. As the discs 124, 128 are attached to the post 3, they remain aligned with the fixed legs 4 on the base in the same orientation. The portions of the discs 124, 128 that were removed in this configuration, being a predefined angle, for example, approximately 150°, of full rotation, reflects the safe rotation range of the body support arrangement 7 when the base 2 is only in the stabilizing condition on one side. The sections of the discs 124, 128 that remain and are fixed to the post 3 reflect the unsafe rotation range when the base 2 is only in the stabilizing condition on one side.

Figure 20A:
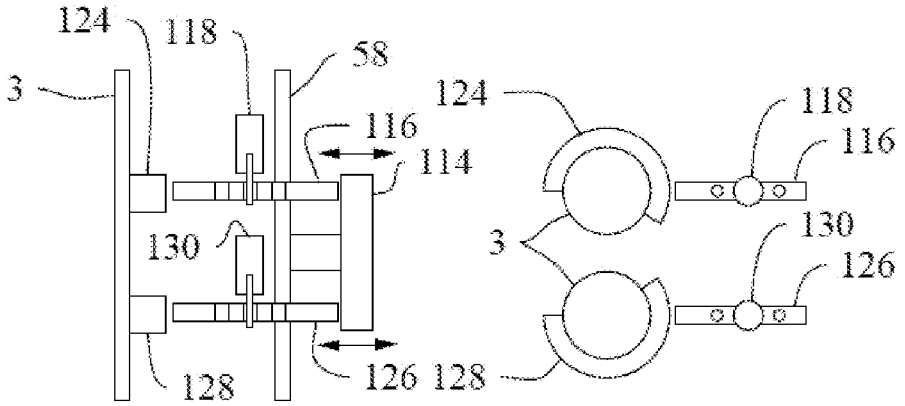
FIGS. 20A-C are top elevational schematic views of the discs and push rods in the full rotation mode (FIG. 20A), the partial right rotation mode (FIG. 20B), and the partial left rotation mode (FIG. 20C) suitable for use with mobile lift 1, 1', 1" or 1'"
Figure 20B:
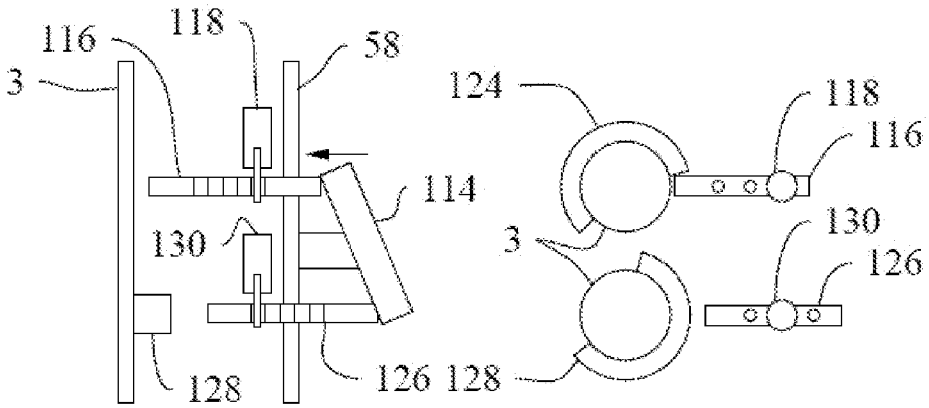
Figure 20C:
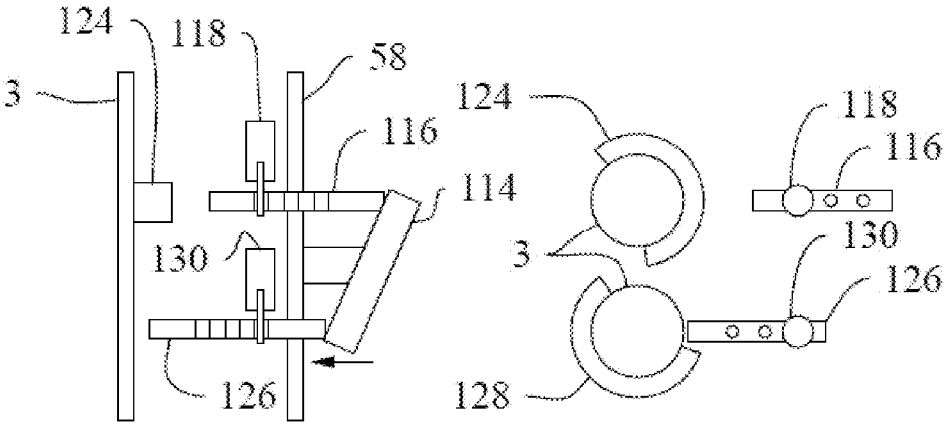

Referring to FIGS. 19-20C, partial rotation can be activated by selecting either Right Partial Rotation or Left Partial Rotation. This can be accomplished by pushing or pivoting the lever 114 in either at the top or at the bottom. The lever 114 is interlocked by means of two solenoids 118, 130 that extend through the series of holes in top and bottom push rods 116, 126, respectively.

Full rotation of the head 5 may be accomplished by keeping the lever 114 in a non-pushed configuration, as illustrated in FIG. 20A. In this configuration, the ends of the push rods 116, 126 are not received in the removed sections of their corresponding discs 124,128.

A partial rotation selection can be made when the base 2 is in the retracted condition, and as such the solenoids 118, 130 interlock the lever 114 from having any movement whilst the base is not in this condition. Partial rotation mode is selected by pushing either pushrod 116, 126 into the cavity of the portion of the disc 124, 128 that was removed, i.e. the 150° portion. The base 2 is put into a partial stabilizing condition, and the lever 114 is interlocked to remain in the chosen position, as best illustrated in FIGS. 20B and 20C. As such, the selection for partial rotation cannot be changed whilst the base 2 is in the stabilizing condition.

Once rotation reaches the end of this safe range, the push rod 116, 126 physically makes contact with the portion of the disc 124, 128 that was mounted on the post 3, and physically prevents the head from any further rotation in that direction. Although this is a mechanical safeguard against rotation outside the safe range, electrical switches (not shown) mounted on the discs 124, 128 can cause driven rotation to stop as well.

Once the base 2 is put into the retracted condition, the rotation mode can be changed, as electronic sensors on the folding legs 4*a* (not shown) will provide a signal to the control unit, causing the solenoids 118, 130 to retract and allow rotation selection lever 114 to move.

Optical couplers (not shown) may also be included to provide the electronic signal to the programmable control unit of whether a partial rotation mode is selected or not by using the holes in the pushrods 116, 126 as well. This electronic signal is used by the control unit 18 to move the corresponding foldable leg 4*a* into the stabilizing condition based on the partial rotation mode selected, or to move both foldable legs 4*a* into the stabilizing condition if no partial rotation mode is selected. Electronic switches and sensors fitted to folding legs 4*a* (not shown) can also be used to provide electronic confirmation signals that the base 2 is in the desired position according to the selections made.

Figure 14A:
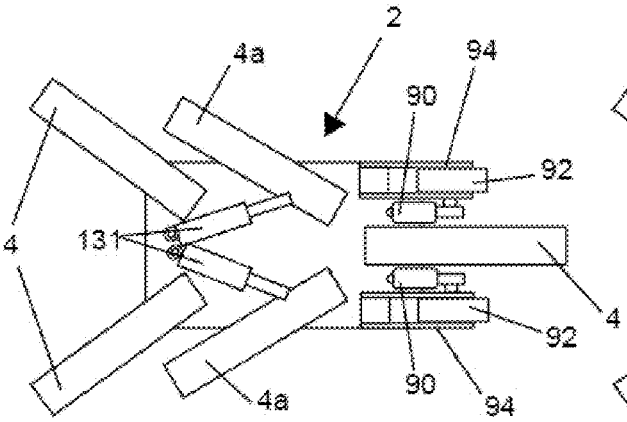
FIG. 14A-B are plan views of motorized means for moving the folding legs 4*a;*
Figure 14B:
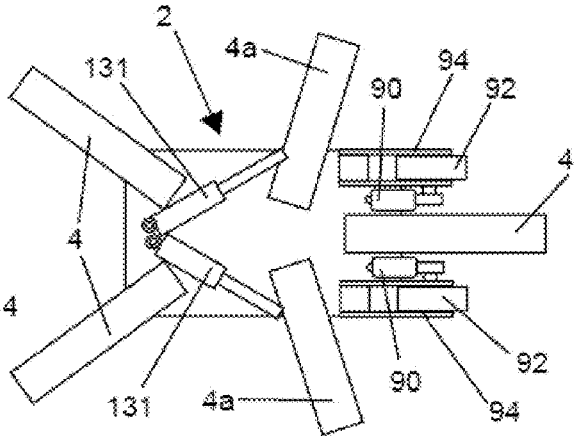

In some embodiments, and to allow the partial rotation functionality, each of the foldable legs 4*a* can be moved independently between stabilizing and retracted conditions through the use of a linear actuator 131 or the like, as best illustrated in FIGS. 14A-B. FIG. 14A shows the base 2 in the retracted condition whilst FIG. 14B shows the base 2 in the stabilizing condition. A programmable control unit 18 can be utilized to control each linear actuator 131 independently, and which also controls other electronic functions of the lift 1.

Referring now to FIGS. 18A and 18B, rotation of the head 5 about the post 3 will be described. The head 5 is rotatably fitted to the post 3 by using two taper roller bearings 180, 181. These bearings 180, 181 are biased towards radial forces during rotation of the head 5 under load, and at the same time will carry the head 5 to which the body support arrangement is attached to via the lifting arrangement 6. Rotation of the head 5 about the post 3 is achieved by placing a ring gear 134 on the post 3 between the two taper roller bearings 180, 181 and driving this with a worm drive motor assembly 140 or similar, which is mounted to the head 5 where accessible to the user when supported by the lifting arms. Locators 182 are fitted to the bottom of the head 5 below the lower taper bearing 181 to prevent the head 5 from lifting.

Figure 21A:
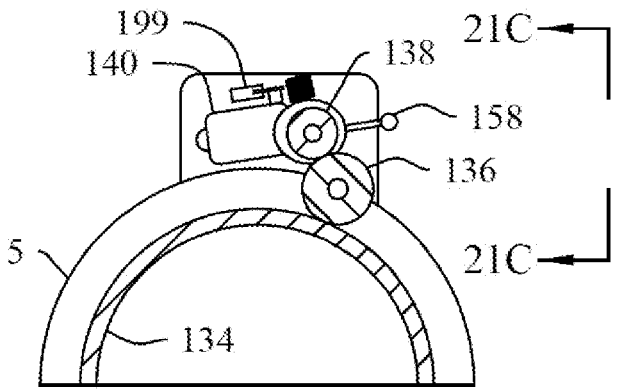
FIG. 21A-B is an enlarged top cross-sectional schematic view of the worm drive motor assembly in an engaged and disengaged position suitable for use with mobile lift 1, 1', 1" or 1'"
Figure 21B:
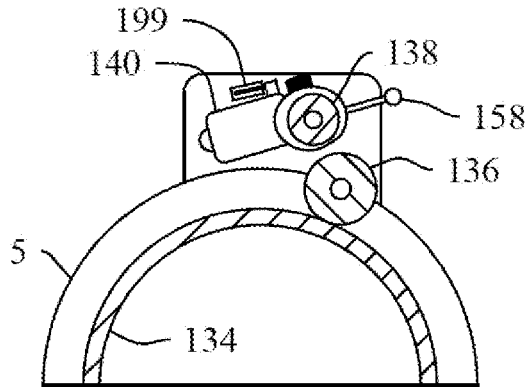

As best illustrated in FIGS. 18B and 21, the worm drive motor 140 can be used to effect rotation, which is hingedly mounted on the head 5 and interfaces with the ring gear 134 via intermediate gear 136 which is rotatably attached to the head. The worm drive motor 140 can be capable of being manually disengaged with the intermediate gear 136 to allow free rotation by manually pushing/rotating the head 5 about the post 3, as best illustrated in FIG. 21B. This free rotation can be limited to only being operational when the folding legs of the lift device are in the stabilizing condition.

This mechanism can be interlocked when the base 2 is not in the stabilizing condition, which will prevent the drive motor 140 from being disengaged to effect free rotation. Interlock can be achieved by solenoid 199 being at rest with the actuator extended, as best illustrated in FIG. 21A, preventing the drive motor 140 from being hinged and moved away to disengage a drive gear 138 of the motor 140 from an intermediate gear 136 as a bracket 238 on the motor 140 pushes against the solenoid actuator.

When the base is in the stabilizing condition, the solenoid 199 can be electronically energized and the actuator retracted, as best illustrated in FIG. 21B, allowing the motor 140 to be hinged and moved away to disengage the drive gear 138 from the intermediate gear 136. The motor 140 can be hinged between the engaged position (FIG. 21A) and disengaged position (FIG. 21B) by means of the spring loaded selection lever 158 attached thereto and protruding through to the outside of the enclosure through the gated slot 160, which locates the lever 158 in either one of the two positions.

Figure 21C:
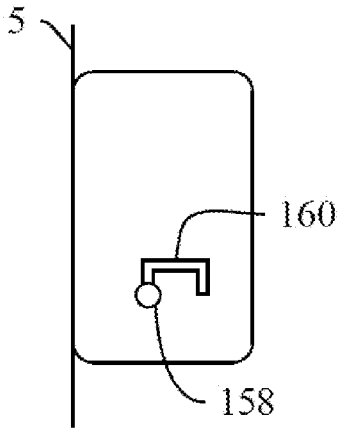
FIG. 21C is an enlarged side view of the drive motor enclosure showing the selection lever and selection gate taken along line 21C-21C in FIG. 21A.

The movement of the selection lever 158 can be controlled or limited by the slot or gate 160 defined through the drive motor enclosure, as best illustrated in FIG. 21C. One portion of the gate 160 can be associated with the engaged position and another portion can be associated with the disengaged position.

The solenoid 199 can be controlled by the control unit 18, which senses when the base is in the stabilizing condition.

Figure 22:
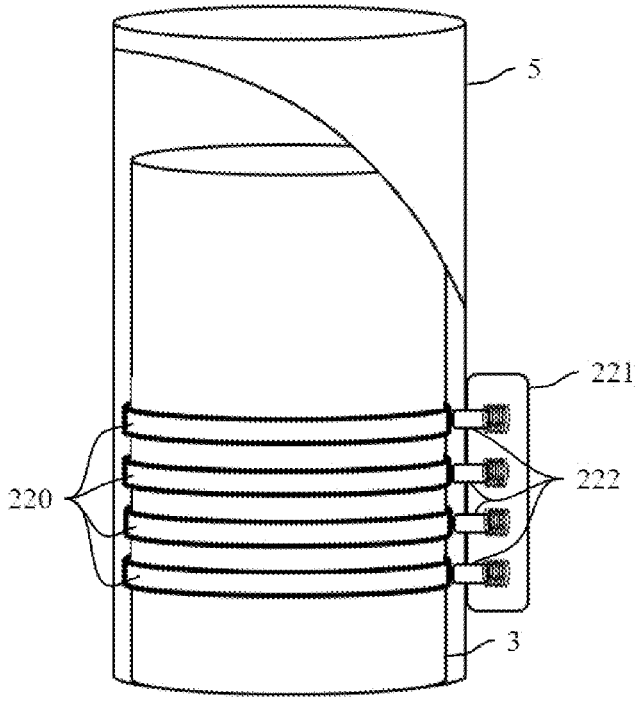
FIG. 22 is a cross-sectional view of the slip ring and brush assembly associated with the head 5 and the post 3 suitable for use with mobile lift 1, 1', 1" or 1'"

As the head 5 rotates about the post 3, the electric signals pertaining to the base 2 of the lifting device 1, have to be transmitted to the control unit which is mounted on the head. To complete this electrical connection through a rotating assembly, a slip ring and brush assembly is incorporated as best illustrated in FIG. 22. The slip rings 220 are fitted to the post 3, whilst the brush assembly 221 which contains a number of spring loaded brushes 222 is fitted to the head 5 with the brushes protruding through holes in the head 5 in order to remain in contact with the slip rings 220 as the head 5 rotates about the post 3. Electrical conductors are terminated on each brush and slip ring combination in order to complete the circuit.

Figure 23:
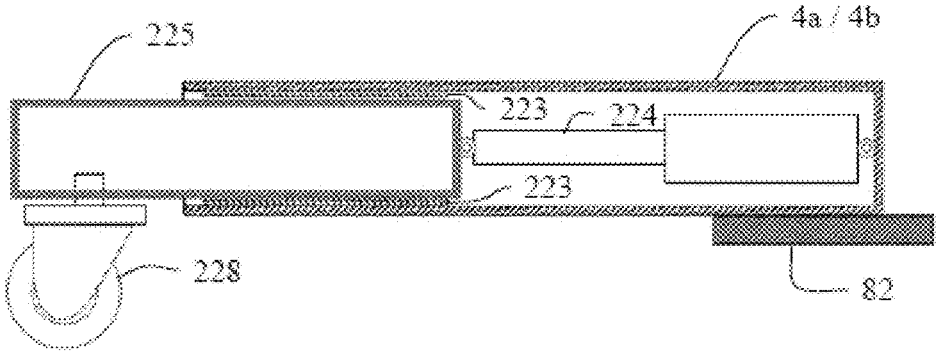
FIG. 23 is an embodiment of a leg 4 with a telescopic section 225 extending therefrom.

In another embodiment, one or more of the legs 4*a*, 4*b* included on the base 2 may be configured to include a telescopic section 225 which can be extended, to effectively provide a longer leg and improve the stability of the lifting device 1, or retracted into the leg 4*a*, 4*b* and thereby reducing the effective width or footprint of the base of the lifting device. The telescopic section 225 of the leg 4*a*, 4*b* is extended or retracted by means of a linear actuator 224 or other motorized means which is fitted to the associated leg 4*a*, 4*b*. This embodiment is best illustrated in FIG. 23 which provides a side view of a leg 4*a*, 4*b* on the base 82 with the one side exposed, showing the configuration of the linear actuator 224 which is coupled at one end to telescopic extension 225 and to the leg 4*a*, 4*b* or base 82 at the other end. The linear actuator 224 is controlled by the control unit 18 and the castor wheel 228 is mounted to the telescopic extension 225 instead of the leg 4, 4*a*. The telescopic section 225 may be guided within the leg for relative longitudinal, sliding movement by polymeric, typically Vesconite™, bearings 223 as illustrated, but guiding sliding means is not limited to the polymeric.

In some embodiments, the present technology can include inductive charging, wireless charging, or cordless charging. When not in use, the lift 1 can be maneuvered by means of the drive wheels 92 onto a charging pad making use of inductive charging. It can be appreciated that an automated navigation system can be utilized allowing the lift device to maneuver to the charging pad without assists or control from the user. Another option for charging is to provide a charging station where the lift device gets moved to and in physical contact with the charging terminals, after having allowed for similar connection on the lift itself. It can be appreciated that the lift device can be controlled by remote control via radio frequency remote, Bluetooth, Wi-Fi or smartphone. Artificial Intelligence can also be utilized with the lift device.

Even though the lift device of the present invention is designed to enable independence, it would be useful to log/communicate certain usage events to interested parties like family members that are not at home, e.g. when the user is being supported by the lifting arms and when he is no longer supported. These can include a notice when lift in use, alarms when the user is supported by the lifting arms for extended period of time or when a tilt sensor detects that the lift has tilted more than a maximum preset amount.

Figure 24:
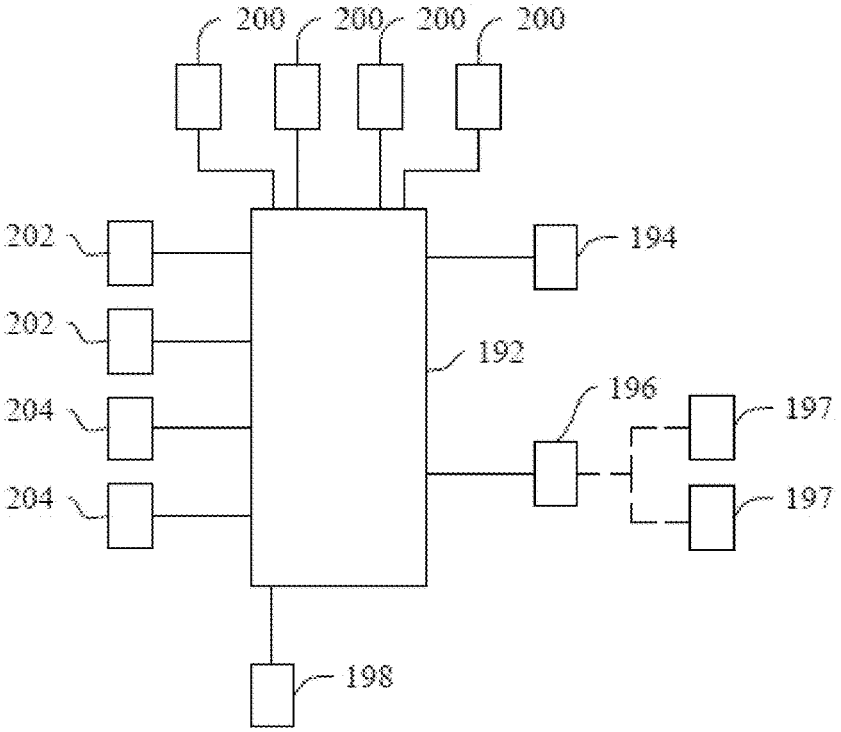
FIG. 24 is a view of an electronic control unit (ECU) which may form part of the mobile lift assembly 1, 1', 1" or 1'".

Referring to FIG. 24, the elements and operations of the lift device 40 can be controlled by an electronic control system. The electronic control system can include a programmable controller or processing unit 192, a user interface or remote control 194 in operable communication with the processing unit, and a transmitter or receive or transceiver 196 in operable communication with the processing unit. The transceiver 196 is capable of communication with remote device such as, but not limited to, smartphones or "Internet of Things" (IoT) 197. At least one RAM memory and/or at least one non-volatile long term memory can be operably connected or connectable with the processing unit 192. A display 198 in operable communication with the processing unit can be utilized for displaying information regarding the lift device 40.

One or more electronic switches or sensors 200 can be utilized to determine operational status or conditions of elements of the lift 1. These switches or sensors 200 are in operable communication with the processing unit 192, which forms an integral part of the control unit 18.

The processing unit 192 can be in operable communication with any or all of the motors 202 and/or actuators 204 associated with the lift 1. Commands from the remote control 194, transceiver 196 and/or switches 200 can be analyzed by the processing unit 192 to provide control signals to an appropriate motor 202 and/or actuator 204.

It can be appreciated that the lift 1 and the electronic control unit 18 can be configured or configurable as a complete system. Alternatively, it can be appreciated that the electronic control unit can be configured or configurable as a module connectable in the lift 1. The control unit 18 can include, but not limited to, a graphics processing unit (GPU), digital signal processor (DSP), Active Server Pages (ASP), central processing unit (CPU), accelerated processing unit (APU), Application Specific Integrated Circuit (ASIC). Even further the control unit can be configured or configurable with software or programming code as part of an operating system or application running on or controlling the lift 1.

In various example embodiments, the electronic control unit of the lift 1 operates as a standalone device or may be connected (e.g., networked) to other devices. In a networked deployment, the electronic device may operate in the capacity of a server or a client machine in a server-client network environment, or as a peer machine in a peer-to-peer (or distributed) network environment. The electronic device may be a personal computer (PC), a tablet PC, a set-top box (STB), a personal digital assistant (PDA), a cellular telephone, a portable music player (e.g., a portable hard drive audio device such as an Moving Picture Experts Group Audio Layer 3 (MP3) player), a web appliance, a network router, switch or bridge, or any machine capable of executing a set of instructions (sequential or otherwise) that specify actions to be taken by that device. Further, while only a single electronic device is illustrated, the term "device" shall also be taken to include any collection of devices that individually or jointly execute a set (or multiple sets) of instructions to perform any one or more of the methodologies discussed herein.

The example electronic control unit of the lift 1 includes a processor or multiple processors (e.g., CPU, GPU, or both), and a main memory and/or static memory, which communicate with each other via a bus. In other embodiments, the electronic control unit of the lift 1 may further include a video display (e.g., a liquid crystal display (LCD)). The electronic control unit of the lift 1 may also include an alpha-numeric input device(s) (e.g., a keyboard), a cursor control device (e.g., a mouse), a voice recognition or biometric verification unit (not shown), a drive unit (also referred to as disk drive unit), a signal generation device (e.g., a speaker), a universal serial bus (USB) and/or other peripheral connection, and a network interface device. In other embodiments, the electronic control unit of the lift 1 may further include a data encryption module (not shown) to encrypt data.

An image processing unit may be utilized and include a module operably associated with a drive unit, with the drive unit including a computer or machine-readable medium on which is stored one or more sets of instructions and data structures (e.g., instructions) embodying or utilizing any one or more of the methodologies or functions described herein. The instructions may also reside, completely or at least partially, within the memory and/or within the processors during execution thereof by the electronic control unit of the lift 1. The memory and the processors may also constitute machine-readable media.

The instructions may further be transmitted or received over a network via the network interface device utilizing any one of a number of well-known transfer protocols (e.g., Extensible Markup Language (XML)). While the machine-readable medium is shown in an example embodiment to be a single medium, the term "computer-readable medium" should be taken to include a single medium or multiple media (e.g., a centralized or distributed database and/or associated caches and servers) that store the one or more sets of instructions. The term "computer-readable medium" shall also be taken to include any medium that is capable of storing, encoding, or carrying a set of instructions for execution by the device and that causes the device to perform any one or more of the methodologies of the present application, or that is capable of storing, encoding, or carrying data structures utilized by or associated with such a set of instructions. The term "computer-readable medium" shall accordingly be taken to include, but not be limited to, solid-state memories, optical and magnetic media, and carrier wave signals. Such media may also include, without limitation, hard disks, floppy disks, flash memory cards, digital video disks, random access memory (RAM), read only memory (ROM), and the like. The example embodiments described herein may be implemented in an operating environment comprising software installed on a computer, in hardware, or in a combination of software and hardware.

It is appreciated that the software application is configured or configurable to be stored in any memory of the electronic control unit of the lift 1 or on a remote computer in communication with the electronic control unit of the lift 1. The software application is configured or configurable to include the interface capable of allowing a user to define custom parameters for controlling the motors 200 and/or actuators 204.

While embodiments of the lift device have been described in detail, it should be apparent that modifications and variations thereto are possible, all of which fall within the true spirit and scope of the present technology. With respect to the above description then, it is to be realized that the optimum dimensional relationships for the parts of the present technology, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present technology. For example, any suitable sturdy material may be used instead of the above-described. And although assisting users have been described, it should be appreciated that the lift device herein described is also suitable for lifting and moving any object.

Therefore, the foregoing is considered as illustrative only of the principles of the present technology. Further, since numerous modifications and changes will readily occur to those skilled in the art, it is not desired to limit the present technology to the exact construction and operation shown and described, and accordingly, all suitable modifications and equivalents may be resorted to, falling within the scope of the present technology.

In compliance with the statute, the invention has been described in language more or less specific to structural or methodical features. The term "comprises" and its variations, such as "comprising" and "comprised of" is used throughout in an inclusive sense and not to the exclusion of any additional features.

It is to be understood that the invention is not limited to specific features shown or described since the means herein described comprises preferred forms of putting the invention into effect.

The invention is, therefore, claimed in any of its forms or modifications within the proper scope of the appended claims appropriately interpreted by those skilled in the art.

The invention claimed is:

1. A mobile lifting system comprising:

a base including a plurality of spaced apart legs extending substantially radially relative to a post extending from the base wherein one or more legs of the base are movable between an expanded stabilizing condition and a retracted condition;

a head configured for rotation about the post with the post movably supporting the head, the head having a lifting arrangement attached thereto, the lifting arrangement being arranged for effecting upward and downward movement of a body support arrangement to raise and lower a disabled person during use, the body support arrangement being movable between a supporting position and an inoperative position, the body support arrangement being connected to the base through an electro-mechanical linkage which moves the base into the stabilizing condition when the body support arrangement is in the supporting position and moves the base into the retracted condition when the body support arrangement is in the inoperative position, the head being rotatable about the post for rotational movement of the body support arrangement to transfer a person between two seating positions which are angularly displaced and in proximity of the post; and an actuator configured to be operable by the disabled person to effect movement of the body support arrangement to move the body support arrangement upward and downward on the lifting arrangement and to rotate the head about the post, the post being located substantially at a center of the base to provide stability as the body support arrangement on the head is rotated about the post while supporting the person, and wherein the actuator and the electro-mechanical linkage are operably coupled to move the body support arrangement between the supporting position and the inoperative position;

wherein end portions of the plurality of legs of the base are arranged substantially equally spaced apart on a diameter about the post when the base is in the stabilizing condition, wherein the plurality of legs includes a first plurality of movable legs movably attached to a centrally located base housing and a second plurality of fixed legs fixedly attached to the base housing, and wherein each of the movable legs is movable independently with respect to any other of the first plurality of movable legs from a first radial position to a second radial position to bring the base into a partially stabilizing condition.

2. The mobile lifting system in accordance with claim 1, wherein the electro-mechanical linkage secures the base in the stabilizing condition while the body support arrangement remains in the supporting position.

3. The mobile lifting system in accordance with claim 2, wherein the electro-mechanical linkage comprises a sensing arrangement to sense physical movement of the body support arrangement and a processing unit in communication with the sensing arrangement to, in response to sensing physical movement of the body support arrangement, transmit an electronic signal for operation of a motor to effect a movement of the one or more movable legs in the base, and wherein the electro-mechanical linkage comprises an electronic controller for allowing the disabled person to control and effect movement of the body support arrangement and legs.

4. The mobile lifting system in accordance with claim 3, wherein the partially stabilizing condition corresponds to a partial rotation of the head about the post through an angle of less than 180 degrees or through an angle of more than 90 degrees.

5. The mobile lifting system in accordance with claim 4, wherein each of the movable legs is movable independently with respect to any other of the first plurality of movable legs from the first radial position towards one of the plurality of fixed legs located adjacent the movable legs to bring the base into the partially stabilizing condition which corresponds to the partial rotation of the head about the post.

6. The mobile lifting system in accordance with claim 5, wherein the actuator is selected from the group consisting of a control panel provided on the head, a wired remote control provided on the head, and a control panel provided on the head associated with wireless remote controlling means; and wherein in a first operable configuration the actuator is accessible to the person supported by the body support arrangement for effecting control of functions of the mobile lifting system; and wherein in a second operable configuration, the actuator is accessible to the person while not supported by the body support arrangement for effecting control of the functions of the mobile lifting system.

7. The mobile lifting system in accordance with claim 6, wherein the actuator turns an outer rotary gear, rotatably supported in relation to the head that runs on a track provided by an inner annular gear, which is coaxial and fixed relative to the post; and wherein the outer rotary gear is turned by one or more motors to effect driven rotation of the head about the post; and wherein the outer rotary gear is configured to be disengaged from the inner annular gear allowing free rotation of the head about the post.

8. The mobile lifting system in accordance with claim 7 further comprises a limiting arrangement to limit the rotation of the head about the post, wherein the limiting arrangement comprises a selectable means to limit the rotation of the head about the post to at least one portion of a full rotation, and wherein a selected partial rotation of the head about the post coincides with the base being in a corresponding partially stabilizing condition.

9. The mobile lifting system in accordance with claim 1, wherein the base is associated with a set of drive wheels configured for operation to propel the mobile lifting system, wherein each of the drive wheels is associated with a drive wheel carrier including a spring configured to pivot the drive wheel towards a floor surface, and further comprising a wheel motor operably associated with each drive wheel and a raising mechanism associated with each drive wheel, the raising mechanism comprising a pivoting arrangement to pivot the drive wheel towards and away from the floor surface respectively.

10. The mobile lifting system in accordance with claim 9, wherein the body support arrangement includes a pair of spaced apart arms extending from a cross beam pivotably secured to the lifting arrangement with a motor operably coupled with the cross beam to rotate the body support arrangement between the supporting position and the inoperative position.

11. The mobile lifting system in accordance with claim 10, wherein the lifting arrangement is operatively coupled to a support structure of the lifting arrangement, the support structure being positioned at a radially off center location relative to a central longitudinal axis of the post whereby in the supporting position, the body support arrangement extends transversely relative to the support structure to provide cantilever support to the disabled person supported by the body support arrangement, wherein an in-use lower portion of the support structure is fixedly attached to the head.

12. The mobile lifting system in accordance with claim 11, wherein the support structure comprises one selected from the group consisting of one or more tracks for engaging a carriage supporting travel of the lifting arrangement along the support structure, and one or more substantially upright members for supporting the lifting arrangement.

13. The mobile lifting system in accordance with claim 11, wherein the body support arrangement comprises one or more electronic devices for facilitating synchronization of positions of the body support arrangement with movement of the movable legs of the base, wherein the body support arrangement is attached to the lifting arrangement, the body support arrangement comprising a base frame and a shaft with a mounting arrangement in rotational engagement relative to the shaft, the mounting arrangement allowing the mounting of one or more body support structures.

14. The mobile lifting system in accordance with claim 13 further comprising:

one or more electrical limit switches positioned relative to the base frame of the body support arrangement, the limit switches being positioned to interface with a disc mounted on the shaft such that upon rotating the lifting arrangement through the shaft into the supporting position, the limit switches interfaces with the disc to actuate the movable legs into a stabilizing position and wherein the when the lifting arrangement rotates through the shaft into the inoperative position, the limit switches no longer interface with the disc thereby resulting in the movement of the movable legs into the retracted condition; and a sensor positioned relative to the shaft and the mounting arrangement for sensing an orientation of the lifting arrangement for assessing if the lifting arrangement is in the supporting position, the inoperative position or in a position in between the supporting and the inoperative position.

15. The mobile lifting system in accordance with claim 11, wherein the body support arrangement is linked to the support structure by one or more carrier members extending between the support structure and the body support arrangement, and further comprising:

a first pivoting arrangement to allow the body support arrangement to pivot relative to the carrier members between the supporting position and the inoperative position; and a second pivoting arrangement for effecting pivotal movement of the one or more carrier members relative to the support structure.

16. The mobile lifting system in accordance with claim 15, further comprising a strut member linked to one or more of the carrier members for raising or lowering the carrier members thereby allowing the body support arrangement to be moved upwardly or downwardly during use.

17. The mobile lifting system in accordance with claim 16, wherein the body support arrangement comprises one or more electronic devices for facilitating synchronization of positions of the body support arrangement with movement of the movable legs of the base.

18. The mobile lifting system in accordance with claim 17, wherein the body support arrangement is attached to the lifting arrangement, the body support arrangement comprising a base frame and a shaft with a mounting arrangement in rotational engagement relative to the shaft, the mounting arrangement allowing the mounting of one or more body support structures.

19. The mobile lifting system in accordance with claim 18 further comprising:

one or more electrical limit switches positioned relative to the base frame of the body support arrangement, the limit switches being positioned to interface with a disc mounted on the shaft such that upon rotating the lifting arrangement through the shaft into the supporting position, the limit switches interfaces with the disc to actuate the movable legs into af stabilizing position and wherein the when the lifting arrangement rotates through the shaft into the inoperative position, the limit switches no longer interface with the disc thereby resulting in the movement of the movable legs into the retracted condition; and a sensor positioned relative to the shaft and the mounting arrangement for sensing an orientation of the lifting arrangement for assessing if the lifting arrangement is in the supporting position, the inoperative position or in a position in between the supporting and the inoperative position.

* * * * *